US009427757B2

(12) United States Patent
Nuzzo et al.

(10) Patent No.: US 9,427,757 B2
(45) **Date of Patent: *Aug. 30, 2016**

(54) AIRBRUSH

(75) Inventors: Stefania Nuzzo, Paris (FR); Gabin Vic, Semoy (FR); Eric Parris, Sannois (FR)

(73) Assignee: L'OREAL, Paris (FR)

( * ) Notice: Subject to any disclaimer, the term of this patent is extended or adjusted under 35 U.S.C. 154(b) by 369 days.

This patent is subject to a terminal disclaimer.

(21) Appl. No.: 13/637,504

(22) PCT Filed: Mar. 30, 2011

(86) PCT No.: PCT/IB2011/051349

§ 371 (c)(1),
(2), (4) Date: Dec. 4, 2012

(87) PCT Pub. No.: WO2011/121551

PCT Pub. Date: Oct. 6, 2011

(65) Prior Publication Data

US 2013/0074864 A1 Mar. 28, 2013

Related U.S. Application Data

(60) Provisional application No. 61/324,316, filed on Apr. 15, 2010.

(30) Foreign Application Priority Data

Mar. 30, 2010 (FR) ..... 10 52345

(51) Int. Cl.

| | |
|---|---|
| ***B05B 11/00*** | (2006.01) |
| ***B05B 7/24*** | (2006.01) |
| *B05B 15/00* | (2006.01) |

(52) U.S. Cl.

CPC ..... *B05B 7/2478* (2013.01); *B05B 7/2408* (2013.01); *B05B 11/00* (2013.01); *B05B 15/00* (2013.01)

(58) Field of Classification Search

CPC .... B05B 7/2408; B05B 7/2478; B05B 15/00; B05B 11/00

USPC ..... 239/369, 379, 319, 346, 353, 302, 309

See application file for complete search history.

(56) References Cited

U.S. PATENT DOCUMENTS

| | | |
|---|---|---|
| 1,638,550 A | 8/1927 | Paasche |
| 1,703,219 A | 2/1929 | Wold |

(Continued)

FOREIGN PATENT DOCUMENTS

| | | |
|---|---|---|
| DE | 10 2007 048 440 B3 | 4/2009 |
| EP | 0 492 333 A1 | 7/1992 |

(Continued)

OTHER PUBLICATIONS

Sep. 20, 2011 International Search Report and Written Opinion issued in International Patent Application No. PCT/IB2011/051349.

(Continued)

*Primary Examiner* — Robyn Doan

(74) *Attorney, Agent, or Firm* — Oliff PLC

(57) ABSTRACT

A spray system including an airbrush; one or more removable containers that are closed initially, and that each contain a composition for spraying onto human keratinous materials; and a junction device that connects the container to the airbrush, the device including at least a composition-outlet first orifice enabling the composition to leave the container in order to be sprayed via the airbrush, and at least an air-inlet second orifice enabling air intake by the container.

17 Claims, 4 Drawing Sheets

(56) References Cited

U.S. PATENT DOCUMENTS

| | | | | | |
|---|---|---|---|---|---|
| 1,863,782 | A | * | 6/1932 | Young | 137/255 |
| 2,057,434 | A | * | 10/1936 | Jaden et al. | 251/149.1 |
| 2,550,404 | A | | 4/1951 | Chasan et al. | |
| 2,868,585 | A | | 1/1959 | Esser | |
| 2,999,646 | A | | 9/1961 | Wagner | |
| 3,060,956 | A | | 10/1962 | Menzie | |
| 3,135,467 | A | * | 6/1964 | Greenman | 239/304 |
| 3,191,869 | A | | 6/1965 | Gilmour | |
| 3,780,943 | A | * | 12/1973 | Lilja | 239/8 |
| 3,970,121 | A | * | 7/1976 | Brandt | 141/2 |
| 4,546,922 | A | * | 10/1985 | Thometz | 239/304 |
| 4,623,095 | A | | 11/1986 | Pronk | |
| 4,742,963 | A | * | 5/1988 | Marvaldi | 239/337 |
| 4,955,544 | A | * | 9/1990 | Kopp | 239/304 |
| 5,086,978 | A | | 2/1992 | Fertig | |
| 5,253,900 | A | * | 10/1993 | Snyder | 285/12 |
| 5,433,191 | A | * | 7/1995 | Haber et al. | 128/200.14 |
| 5,967,197 | A | * | 10/1999 | Shown | 141/18 |
| 6,321,941 | B1 | * | 11/2001 | Argentieri et al. | 222/81 |
| 6,341,736 | B1 | | 1/2002 | Liao | |
| 6,345,773 | B1 | | 2/2002 | Shanklin et al. | |
| 6,386,392 | B1 | * | 5/2002 | Argentieri et al. | 222/81 |
| 6,971,589 | B2 | | 12/2005 | Incardona et al. | |
| 7,861,951 | B2 | | 1/2011 | Juo | |
| 2003/0108487 | A1 | * | 6/2003 | Bara | 424/47 |
| 2004/0222316 | A1 | * | 11/2004 | Scholz | 239/318 |
| 2006/0278661 | A1 | * | 12/2006 | Cooper | B05B 5/03 222/321.1 |
| 2007/0018016 | A1 | | 1/2007 | Yechouron | |
| 2007/0090206 | A1 | | 4/2007 | Barch et al. | |
| 2009/0014474 | A1 | | 1/2009 | Kennedy et al. | |
| 2009/0090297 | A1 | | 4/2009 | Kitajima | |
| 2009/0114236 | A1 | * | 5/2009 | Mehta | 132/200 |

FOREIGN PATENT DOCUMENTS

| | | | |
|---|---|---|---|
| EP | 0 678 334 | A2 | 10/1995 |
| EP | 1 470 867 | A2 | 10/2004 |
| EP | 1 598 117 | A1 | 11/2005 |

OTHER PUBLICATIONS

Sep. 20, 2011 International Search Report and Written Opinion issued in International Patent Application No. PCT/IB2011/051350.

Nov. 19, 2010 Preliminary Search Report issued in French Patent Application No. 1052345 (with translation).

Nov. 25, 2010 Preliminary Search Report issued in French Patent Application No. 1052340 (with translation).

U.S. Appl. No. 13/637,556, filed Nov. 28, 2012.

May 4, 2015 Office Action issued in U.S. Appl. No. 13/637,556.

* cited by examiner

AIRBRUSH

The present invention relates to systems and methods of treating human keratinous materials, in particular the hair and/or the scalp.

BACKGROUND

Some cosmetic compositions, in particular for treating the hair or the scalp, are packaged in closed containers, e.g. provided with separate closure means that are fastened by snap-fastening on the container, for example.

The composition is poured from the container directly onto the hair or the scalp, or initially onto the hands and then onto the hair of the scalp.

SUMMARY

The Applicant has studied the possibility of using airbrushes for spraying various cosmetic compositions, in particular onto the hair or the scalp.

Conventional airbrushes comprise a body that may be in the general shape of a pistol or a pen, on top of which a cup is sometimes provided, into which the composition for spraying is poured. Such airbrushes are known as "gravity" airbrushes.

The presence of a cup fastened in permanent manner on the body of the airbrush, and into which the composition is poured, results in numerous manipulations while filling and cleaning the airbrush, that are often accompanied by composition being wasted. Such manipulations are also troublesome when using a composition that requires avoiding contact with the environment, such as a composition that is sensitive to air or that is an irritant.

"Suction feed" airbrushes also exist in which the composition is contained in a container that, after being filled, is coupled, with its neck directed upwards, to the body of the airbrush, the airbrush including a dip tube that extends to the bottom of the container. As with the gravity versions, the suction versions result in tricky manipulations in order to clean the container between two uses. In addition, the ergonomics of such airbrushes is not as good as the ergonomics of cup airbrushes, since the presence of the dip tube is likely to hinder the user in some situations, e.g. when the airbrush is to be manipulated around the face or the head of a person, for example. Furthermore, suction feed airbrushes have an extraction rate that is insufficient.

U.S. Pat. Nos. 1,638,550, 1,703,219, 6,345,773, 2,057,434, and 3,191,869 relate to suction feed airbrushes. European patent application EP 0 492 333 relates to a closure system for closing a sprayable-liquid container that is provided with a dip tube for sucking up the liquid. US application No. 2009/0090297 gives examples of suction feed and gravity airbrushes.

Application EP 1 598 117 relates to an adapter for a spray gun including an expandable reservoir, and application EP 0 678 334 discloses a spray gun that operates by sucking up paint contained in a discardable flexible pouch. Such devices are adapted to very particular containers.

Application EP 1 470 867 A2 describes an airbrush in which the composition for spraying is contained in a container that is suitable for being fastened in removable manner on the body of the airbrush. The container is provided with a valve that closes when the container is not in place, and that opens after the container has been fastened on the airbrush. Although the use of a valve presents advantages by reducing the exposure of the composition to the environment, it results in the container being constructed in a specific manner that increases its cost. In addition, while drying or because of a particulate filler, some compositions are likely to prevent the valve from operating properly, e.g. by causing said valve to jam in its closed or open position.

US application No. 2007/0090206 A1 discloses an airbrush including a housing for receiving a container that is fastened in removable manner on the airbrush. The container includes a valve, thereby posing the same problem as mentioned above. In the airbrush disclosed in that publication, air is taken in on the same side as the side via which the composition is sucked up, via a capillary passage that is formed along an endpiece that is configured to act on the valve and that comes to be engaged in the opening of the container.

Patent DE 10 2007 048 440 relates to a lid for connecting a spray gun to the composition outlet of a paint container. A labyrinth-forming gasket guides the outside air to the bottom of the container.

US application No. 2007/0018016 describes an assembly for spraying a liquid, the assembly including a removable container including an air-intake channel having an air-entry end that is situated below the air-inlet in the container.

There exists a need to improve still further the treatments of human keratinous materials, in particular of the hair and of the scalp, and the systems for implementing them.

First exemplary embodiments of the invention provide a spray system comprising:

- an airbrush;
- one or more removable containers that are closed initially, and that each contain a composition for spraying onto human keratinous materials, in particular the hair and/or the scalp;
- a junction device that connects the container to the airbrush, the device including at least a composition-outlet first orifice enabling the composition to leave the container in order to be sprayed via the airbrush; and
- at least an air-inlet second orifice in the container enabling air intake by the container.

The terms "air inlet" and "composition outlet" should be understood relative to the container once fastened on the junction device.

The relative positions "above", "below", "top", and "level" refer to a state of the airbrush, of the junction device, and/or of the container from which the composition may flow by gravity towards the inlet of the airbrush.

The spray system may include a plurality of containers. The containers may be interchangeable and may contain compositions that are identical or different.

Each container may include one or more openings that are preferably all closed, before the container is used on the airbrush, by any usual closure means, (stopper(s), cap(s), top(s), lid(s), teat(s), . . . ).

The content of the container(s) fastened on the airbrush is in contact with the outside air only via the junction device.

It is advantageous for the container to have neither a vent nor a valve.

The air-inlet orifice is preferably at the level of the composition-outlet orifice. The air-inlet orifice may be directly in contact with the outside air.

The air-inlet orifice may be provided with a check valve.

The device may include an air-intake channel between the air-inlet orifice and an air-entry orifice that communicates with the outside air.

The term "air-intake circuit" means the assembly comprising the air-inlet orifice, the air-intake channel, and the air-entry orifice. The air-intake circuit may optionally be provided with a check valve.

The air-entry may optionally be situated above the composition-outlet orifice and/or the air-inlet orifice.

By way of example, the air-entry orifice is situated more than 1 cm above the air-inlet orifice, better more than 2 cm above said air-inlet orifice.

The air-entry orifice may be situated below the top level of the container.

Preferably, the air-entry orifice is situated above the maximum composition level in the container, once said container is fastened on the junction device, which is itself fastened or connected to the airbrush.

This variant presents numerous advantages.

Firstly, the fact that the air-entry orifice is situated above the air-inlet orifice and above the maximum composition level in the container makes it possible for the air-intake circuit to avoid using a valve that opens when there is suction in the container, and to avoid the drawbacks associated with the use of such a valve in terms of cost of manufacture and of reliability in operation. This is particularly true when the air-entry orifice is situated above the maximum level of composition for spraying. Thus, the air-intake circuit need not have any valve.

In addition, the air-intake channel may have a section that is relatively large, thereby reducing the risk of accidental blockages. By way of example, the air-intake channel may present a section lying in the range 0.1 square millimeters ($mm^2$) to 10 $mm^2$.

The length of the channel is a function of the maximum depth, in the container, of the composition for spraying. By way of example, it lies in the range 5 millimeters (mm) to 500 mm.

The air-entry orifice may open out freely upwards. It may also open out facing the container, in particular onto a vertical inside wall of the junction device. This reduces the risk of dirt entering into the air-intake channel, the risk of said air-inlet channel accidentally blocking, and the risk of composition leaking onto the body of the airbrush and onto the user.

Whatever the variant involved, the invention makes it possible to avoid manufacturing containers that are specifically for use on the airbrush.

In particular, the invention does not need to use a container that is flexible and leaktight. Among bottles that are currently used and that are suitable for the present invention, mention may be made of bottles made of rigid or semi-rigid material, e.g. made of glass or thermoplastic material, this list not being limiting.

By way of example, the invention makes it possible to use containers that are bottles that may also be used by pouring their contents directly onto the surfaces to be treated.

The invention also makes it possible to avoid having to transfer the contents of the container into the airbrush, by making use directly of the initial container to contain the composition for spraying with the airbrush, while said airbrush is being used.

In a variant, the airbrush may be a suction feed airbrush, and the junction device may be provided with a communication system, e.g. a tube, between the composition-outlet orifice and the inlet of the airbrush, thereby enabling suction.

In a variant, the airbrush may be a gravity airbrush.

In exemplary embodiments of the invention, the air-inlet orifice is at the level of the composition-outlet orifice. In these exemplary embodiments, the air-inlet orifice may be directly in contact with the outside air or it may communicate with the outside air via a substantially-horizontal channel.

In other exemplary embodiments of the invention, the junction device includes an air-intake channel coming from the air-inlet orifice, said channel terminating by an air-entry third orifice that communicates with the outside air and that is situated above the first and second orifices for composition outlet and air inlet.

The container may initially be closed when it is made available to the user, containing the composition for spraying.

Each container may include one or more openings that are preferably all closed, before the container is used on the airbrush, by any usual closure means, (stopper(s), cap(s), top(s), lid(s), teat(s), . . . ), this list not being limiting.

By way of example, the container is in the form of a bottle possibly with a neck that is provided with a collar.

By way of example, the closure means are snap-fastened on the collar. The container may be made out of glass or out of a thermoplastic material, and the closure means may be made out of a thermoplastic material.

The closure means may be fitted on the container, i.e. it need not be integral therewith, and it may be made out of the same material as the container.

Thus, by way of example, the closure means are crimped, adhesively-bonded, screw-fastened, heat-sealed, or snap-fastened on the container. The container may be filled before the closure means are put into place. The closure means may be configured to allow the user to remove them from the container, and then put them back into place on the container, so as to close it once again.

The closure means may be removed prior to putting the container into place on the junction device.

After being fastened to the junction device, the container does not present any openings that are directly in contact with the outside air. The only contact with the outside air is made via the air-inlet orifice and possibly the air-intake channel.

The container may be put into place on the junction device with its opening initially directed upwards.

In a variant, the junction device is fastened on the container, then the container and junction device assembly is turned over so as to fasten it on the airbrush. In another variant, the junction device may be fastened on the airbrush in optionally-removable manner, and the airbrush and junction device assembly are turned over for fastening on the container. Once the container is engaged on the junction device, the airbrush may be turned over once again.

During operation of the airbrush, the container is positioned upsidedown with its bottom on top and with its opening directed downwards, the composition for spraying flows from top to bottom in the container, and between the container and the airbrush, e.g. until the composition contained inside the container is used up completely. In the event of using only a fraction of the composition contained in the container, the airbrush may be turned over once again, and the container removed, then re-closed, so as to be ready for subsequent use. However, it is preferable for the container to be of a size such that its contents are dispensed in a single use, so as to reduce the amount of manipulation.

When the container is in place on the airbrush, the closure means may have been completely removed.

If only a fraction of the composition contained in the container is used, then the airbrush may be turned over once again, and the container removed, then re-closed, so as to be ready for subsequent use. However, it is preferable for the container to be of a size such that its contents are dispensed in a single use, so as to reduce the amount of manipulation.

The composition-outlet orifice of the junction device may be a single orifice that opens out facing the opening of the container for example, preferably in centered manner. However, the composition-outlet orifice may be offset relative to the axis of the opening of the container.

At its base, the junction device may include a slope that defines a conical section for example, making it easier for the composition to flow via the outlet orifice towards the inlet of the airbrush, and enabling the container (and any cavity formed between the container and the junction device) to be emptied properly. A centered outlet orifice may enable such a slope to be made.

By way of example, the section of the composition-outlet orifice may lie in the range 0.1 $mm^2$ to 1 square centimeter ($cm^2$), its shape preferably being circular.

By way of example, the section of the air-inlet orifice may lie in the range 0.1 $mm^2$ to 1 $cm^2$, its shape preferably being circular.

By way of example, the section of the air-entry orifice may lie in the range 0.1 $mm^2$ to 1 $cm^2$, its shape preferably being circular.

The junction device may define an upwardly-open housing in which the container is engaged, at least in part, when the device is in place on the airbrush. The junction device may thus surround the container, at least in part, and may contribute to holding it on the airbrush.

The junction device may be entirely outside the container when the container is in place. In other words, the junction device need not include any endpiece or other element that is engaged in the opening of the container when said container is in place. This makes it easier to construct the airbrush and the container.

The junction device may include one or more uprights that preferably do not surround the container completely over its entire height. This makes it possible to form one or more grip zones for gripping the container, making it easier to remove the container and to put it into place. The air-inlet channel may be formed, over at least a fraction of its length, in the thickness of an upright, thereby improving the appearance of the airbrush, e.g. since the air-intake channel is not visible to the user once the container is in place.

The composition may be admitted into the airbrush via the composition-outlet orifice situated in the junction device coaxially about the longitudinal axis of the container, and that may make it easier for the fluid to flow.

The fastening of the container on the junction device may be sealed in various ways.

In exemplary embodiments of the invention, the junction device may include a gasket, preferably an O-ring, that is disposed so as to snap-fasten on the container, e.g. on a collar of the container, and so as to bear in leaktight manner on the container. Such a gasket thus provides two functions of sealing and of fastening, and makes it possible to have an airbrush of relatively simple construction.

The air-entry orifice may be situated above the sealing gasket.

Such a gasket provides a reliable and technically simple solution to the problem of fastening the container on the airbrush. The gasket may be received in an annular groove, e.g. a groove made in the base of the above-mentioned junction device.

The container may be engaged, at least in part, in the housing, when the container is in place on the junction device. The junction device may thus surround the container, at least in part, and may contribute to holding it on the airbrush.

The junction device may be fastened on the body of the airbrush in optionally-removable manner, or it may be incorporated in the body of the airbrush and constitute a portion thereof.

The junction device may include a fastener endpiece for fastening on the body of the airbrush. At its endpiece, the junction device may include sealing means, such as an annular gasket for example, enabling the junction device to be fastened in leaktight manner on the body of the airbrush. The junction device may be snap-fastened, screw-fastened, heat-sealed, adhesively-bonded, or fastened in some other way on the airbrush that is for example a commercially-available airbrush in which the usual cup has been replaced by a junction device of the invention.

In exemplary embodiments, and as mentioned above, it is possible to make the junction device in the form of a portion of the body of the airbrush, the junction device thus not necessarily projecting relative to the body of the airbrush.

The junction device may include perforator means, in particular needles, in order to create passages for the composition and air. Other exemplary embodiments of the invention also provide a junction device for a spray system, said device being arranged so as to connect an airbrush and at least one removable container containing a composition for spraying, the device including perforator means, in particular hollow needles, that are arranged so as to perforate the container.

In these variant exemplary embodiments, only the container need be turned upsidedown and put directly into place on the junction device, without any need for either the airbrush or the junction device to be turned upsidedown. The perforator means may perforate closure means of the container while said container is being put into place on the junction device.

The perforator means may be hollow and respectively include a composition-outlet orifice enabling the composition to be taken, and an air-inlet orifice enabling air intake.

The perforator means may comprise at least two needles, e.g. parallel needles.

The container may be made as a single part and need not include closure means.

The container may include closure means that are perforated when the container is put into place on the junction device.

In other exemplary embodiments, and independently or in combination with the above, the invention also provides a method of treating keratinous materials, in particular the hair and/or the scalp, in which method at least one composition is sprayed onto the hair and/or the scalp by means of a spray system or of a junction device of the invention.

The method may optionally include rinsing the keratinous materials after the composition has been applied by spraying.

The invention also provides a method of treating the hair and/or the scalp, in which method one or more compositions are sprayed onto the surface(s) by means of an airbrush system, in accordance with the exemplary embodiments of the invention as defined above.

In the context of this method, the composition for spraying is initially contained in a container that is closed preferably by valveless closure means.

For the treatment of the hair and/or the scalp, in particular non-therapeutic treatment thereof, the invention also provides using an airbrush system comprising: an airbrush in accordance with exemplary embodiments of the invention; and a plurality of closed and pre-filled interchangeable containers for mounting on the airbrush.

The container need not have any valve. Thus, rather than use containers that are provided with valves and that are specific to the airbrushes used, the invention makes it possible to use less costly containers that are available on the market.

BRIEF DESCRIPTION OF THE DRAWINGS

The invention can be better understood on reading the following detailed description of non-limiting embodiments thereof, and on examining the accompanying drawings, in which:

FIG. 1 shows an example of a spray system (also referred to as an airbrush system) of the invention.

DETAILED DESCRIPTION OF THE EMBODIMENTS

Figure 1:
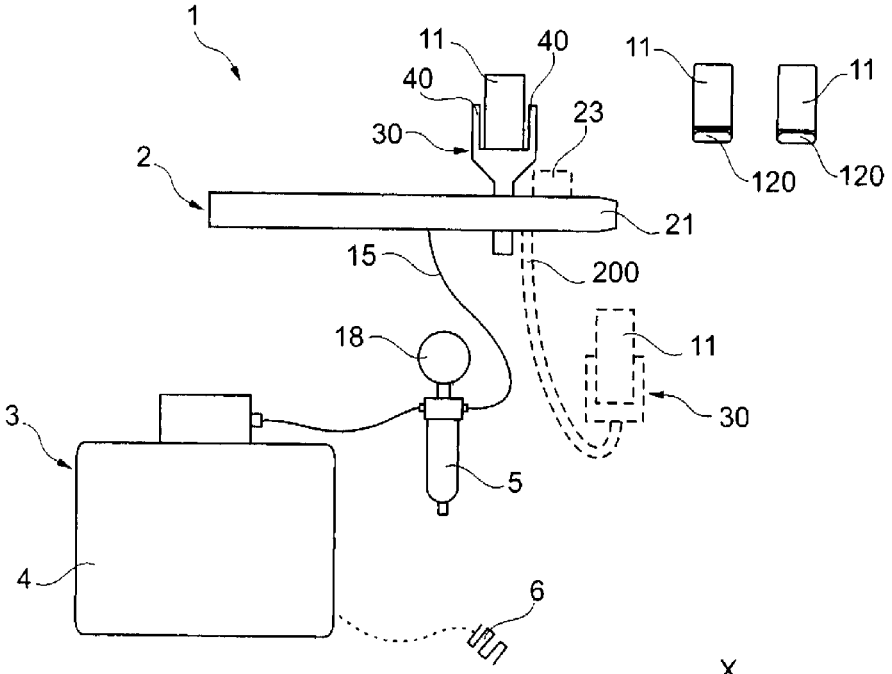
FIG. 1 is a diagrammatic and fragmentary view showing an airbrush and an example of a system for supplying the airbrush with compressed air.
Figure 3:
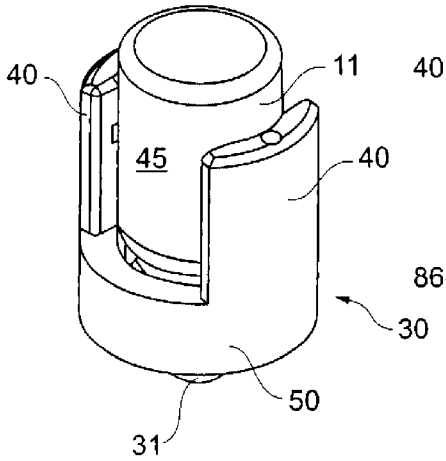
FIG. 3 shows the FIG. 2 junction device after the container has been put into place.
Figure 2:
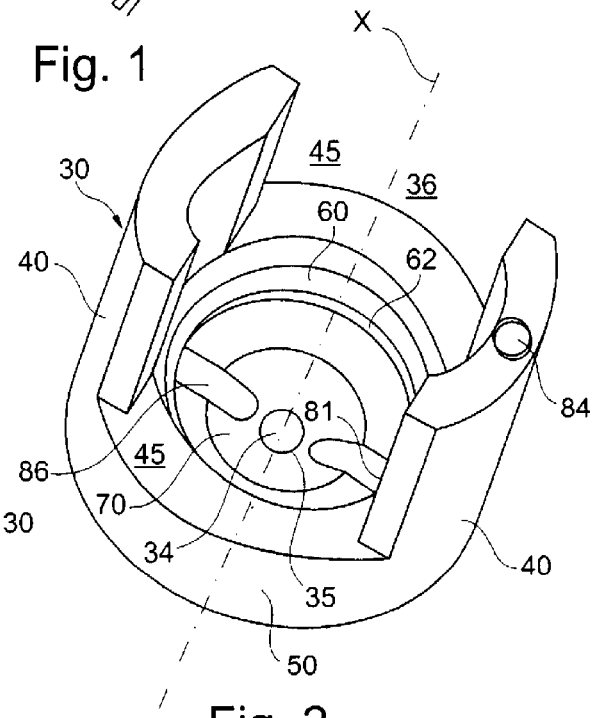
FIG. 2 is a perspective view showing, in isolation, the junction device that is used to receive the container.
Figure 4:
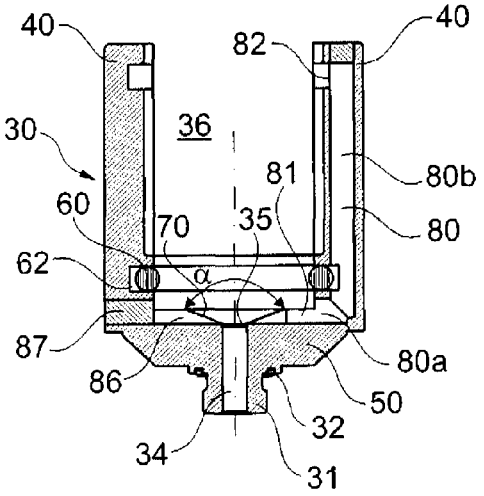
FIG. 4 is a longitudinal section of the junction device with the container removed.

As shown, the airbrush system 1 may comprise an airbrush 2 that is connected to a compressed-gas source, e.g. comprising an air compressor 4 that is connected in conventional manner to the airbrush 2 via a pressure regulator 5 and a flexible hose 15. The compressed-gas source may equally well be an interchangeable or rechargeable capsule of compressed gas, e.g. of compressed air.

The operation of the compressor 4 may possibly be controlled by a foot-actuated system 6 or by any other control means, e.g. hand-controlled or voice-controlled means. In variants, the operation of the compressor 4 may equally well be triggered automatically by detecting movement of the airbrush or its removal from a stand.

The compressor 4 preferably emits sound that is quieter than 40 decibels (dB) and preferably provides an air flow that is greater than or equal to 15 liters per minute (L/min), the compressor 4 optionally has an air supply, preferably with thermal protection, and also preferably has an outlet that is fitted with a quick coupler for fastening the connection hose 15 to the airbrush.

The compressor 4 may be a single-piston, dual-piston, dry, or oil-bath compressor, and the pressure regulator 5 is preferably fitted with a pressure gauge 18.

Figure 14:
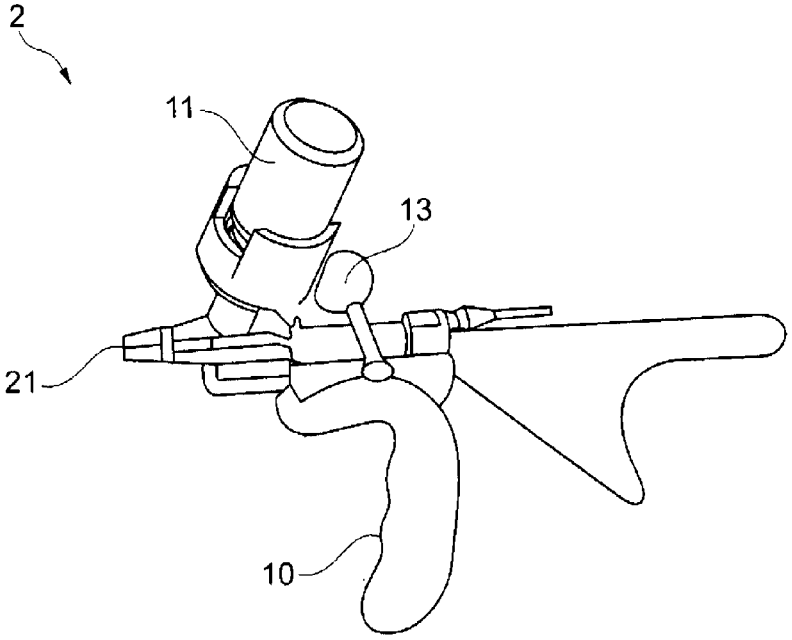
FIG. 14 shows another example of an airbrush.

In known manner, the airbrush 2 includes a handle portion that, by way of example, is defined by the elongate body of the airbrush when said airbrush presents the shape of a pen, or by a handle 10 when said airbrush is of the pistol-grip type, as shown in FIG. 14.

The airbrush 2 may carry a container 11 containing the composition for spraying, the container 11 being in the form of a removable bottle, for example. As shown, the top portion of the airbrush may include a junction device 30 for receiving the container 11.

During operation of the airbrush 2, the composition is sucked up and flows into the airbrush via a composition-taking channel prior to being sprayed.

The container 11 may be transparent or provided with graduations so as to enable the user to see more easily the quantity of composition that is available. By way of example, the volume of composition contained in the container 11 lies in the range 1 milliliter (mL) to 5000 mL, and preferably in the range 1 mL to 1000 mL, even more preferably 1 mL to 500 mL.

Preferably, the flexible hose 15 that connects the airbrush to the compressor 4, and in particular to the air pressure regulator 5, presents a length that is less than or equal to 5 meters (m), and its inside diameter is equal to 4 mm, for example. Preferably, the flexible hose 15 is provided with quick-coupler endpieces.

The airbrush 2 may possibly include a lighting system 23 for illuminating the zone towards which the composition is projected. By way of example, the lighting system 23 comprises one or more light-emitting diodes emitting light that is white or of some other color. Where appropriate, the angle of divergence of the light beam emitted by the light source 23 may be selected so that the illuminated area corresponds substantially to the area touched by the composition when projected from a predefined working distance.

The light source 23 may equally well include a laser pointer making it possible to project a spot of light or a target onto the zone to be treated, making it easier for the user to direct the airbrush 2 in the correct direction. This makes it possible to direct the composition as well as possible, reducing losses due to spraying onto zones at the periphery of the region being treated.

Where appropriate, the projected target appears blurred when the airbrush is not at the correct spraying distance.

The airbrush 2 may be made available to the user with a plurality of pre-filled and closed containers 11, as shown in FIG. 1, e.g. each containing the same composition, so as to enable the user to replace an empty container quickly with a full container, e.g. for treating different people.

The containers 11 may equally well have different contents, e.g. of different composition and/or color, seeking to perform different optionally-complementary treatments, and the user may choose from the containers 11, the container having the composition that corresponds to the treatment that is to be performed.

The spraying parameters, in particular the flowrate of the vector gas (preferably air) and/or the flowrate of sprayed composition, may be adapted manually by the user each time the container 11 is changed, when that is necessary, or during use.

In a variant, the airbrush system 1 is arranged to adapt the operating parameters automatically, as a function of the container 11 that is in place and of the composition that is contained therein, e.g. by means of the airbrush system 1, e.g. the airbrush 2, recognizing which container 11 is being used. By way of example, the reservoirs containers 11 may present identifiers that are recognized by the airbrush system 1. For example, each container may include an electronic chip, an optical code, or portions in relief that are detected by a suitable detector, e.g. present on the airbrush 2, with a processor making it possible to control at least one actuator, so as to change an operating parameter as a function of the information read.

The relative pressure of the compressed air at the inlet to the airbrush 2 may lie in the range 0.2 bar to 3 bar, e.g. being about 0.6 bar.

Preferably, the nozzle 21 equipping the airbrush is selected so that the mean size of the sprayed droplets of composition is centered on a value lying in the range 10 μm to 35 μm, e.g. being about 23 μm (size measured at a distance of 15 cm from the outlet of the nozzle).

Figure 11:
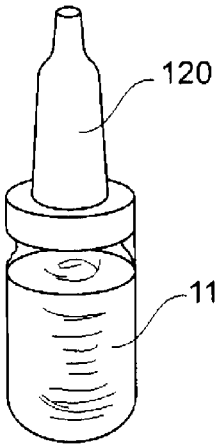
FIGS. 11 and 12 are perspective views showing examples of containers in isolation, before being put into place on the airbrush.
Figure 12:
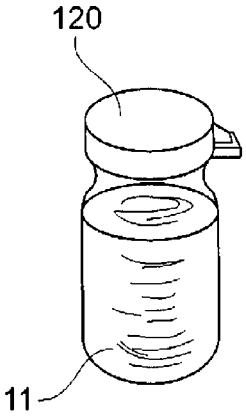

FIGS. 2 to 5 show, in isolation, a first embodiment of the junction device 30 that is suitable for a container 11 that is in the form of a bottle, including a neck provided with a collar 67, and closure means 120, said closure means being as shown in FIGS. 11 and 12, for example.

In the embodiment shown, the junction device 30 includes a fastener endpiece 31, e.g. of the quick-coupler type, for fastening on the body of the airbrush, so as to enable it to be fastened in removable manner on the body of the airbrush.

Naturally, it is not beyond the ambit of the present invention for the junction device 30 to be fastened in non-removable manner on the remainder of the airbrush, or for it to be fastened in removable manner by using means other than a quick coupler.

When the junction device 30 is in place on the airbrush, the axis of the endpiece 31 may be vertical, or it may be oriented obliquely towards the front or the rear of the airbrush.

It is also possible to make the junction device 30 as part of the body of the airbrush, the junction device 30 not necessarily projecting relative to the body of the airbrush.

In the embodiment shown, the junction device 30 includes sealing means, such as an annular gasket 32, enabling the junction device to be fastened in leaktight manner on the airbrush.

In the embodiment under consideration, the junction device 30 includes a composition-taking channel 34 that extends through the endpiece 31. The channel 34 opens out at its top end via a composition-inlet orifice 35, into a housing 36 for receiving the container 11.

The housing 36 is defined by a base 50 and by one or more uprights 40 of the junction device 30 that do not extend all around the container 11, so as to form at least one access zone for accessing the container 11, making it easier to remove the container and to put it into place.

In the embodiment shown, the housing 36 is defined between the base 50 and two diametrally-opposite uprights 40 that form between them two access zones 45 for accessing the container 11.

In the figures, it can also be seen that the height of the uprights 40 is less than the height of the container 11.

In the embodiment under consideration, each upright 40 presents an inside face that is concave facing towards the other upright, and that substantially matches the cylindrical shape of the container 11, but the invention is not limited to any particular shape of upright 40.

The uprights 40 may be made integrally with the base 50 of the junction device 30, as shown, but, in variants that are not shown, the uprights 40 may be fitted on the base 50.

As shown, the base 50 may be made integrally with the endpiece 31 and/or the uprights 40.

In another variant, the junction device 30 may be made out of a plurality of parts, e.g. parts that are interfitted, heat-sealed, adhesively-bonded, or screw-fastened together. In a variant that is not shown, the junction device 30 may equally well include a single tubular upright.

Figure 5:
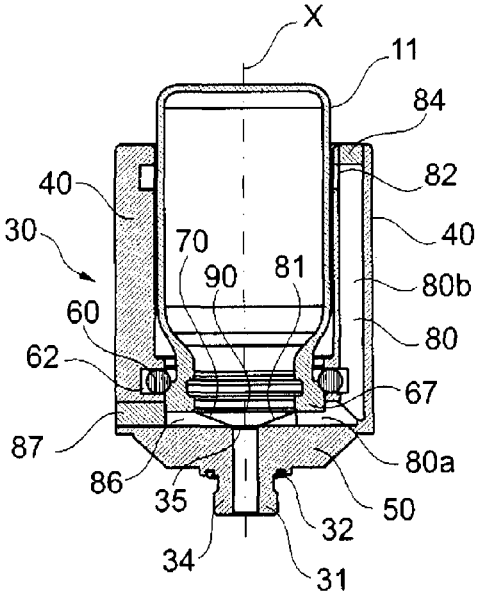
FIG. 5 corresponds to FIG. 4 with the container in place.

By way of example and as shown, the junction device 30 carries a sealing gasket 60 that is received in an annular groove 62 that is formed in the base 50, the sealing gasket 60 possibly having two functions, namely firstly enabling the collar 67 of the container 11 to be snap-fastened so as to prevent it from moving axially in the housing 36, as shown in FIG. 5, and secondly bearing in leaktight manner on the container so as to mount the container in leaktight manner on the airbrush. The bottom of the housing 36 may present a slope 70, e.g. of conical shape of angle α at the apex, which slope converges towards the composition-inlet orifice 35.

In the embodiment shown, the composition-taking channel 34 is coaxial about the longitudinal axis X of the container, the axis X also coinciding with the longitudinal axis of the housing 36. In variants that are not shown, the composition-taking channel 34 may be off-center relative to the longitudinal axis of the container 11 and/or to the longitudinal axis of the housing 36. In addition, in the embodiment shown, the composition-taking channel 34 is directed vertically downwards, but, in variants that are not shown, the channel 34 is not vertical and extends obliquely relative to the longitudinal axis of the container 11 and/or to the longitudinal axis of the housing 36.

Since the container 11 is fastened in leaktight manner on the junction device, an air-intake circuit is provided so as to enable air to enter into the container as said container empties. The container is closed except for the composition-taking and air-intake circuits.

In the embodiment shown in FIGS. 1 to 5, the air-intake circuit includes an air-intake channel 80 that opens out at one end into the bottom of the housing 36 via an air inlet 81.

The top of the air-intake channel 80 communicates with an air entry 82.

The air-intake channel 80 may be formed of two segments 80*a* and 80*b*, as shown in the figures, namely a first segment 80*a* that is oriented perpendicularly to the longitudinal axis X, and a second segment 80*b* that extends parallel to the axis X, the second segment 80*b* advantageously being formed in the thickness of one of the uprights 40, as shown.

The air-entry 82 may face the container 11, the orifice 82 being formed by machining an annular groove in the facing faces of the uprights 40, for example. The top of the air-intake channel 80 may be closed above the air-entry orifice 82 by a fitted stopper 84.

The segment 80*a* may extend a passage 86 that is used for making it, e.g. by machining or by molding, the passage 86 then being closed by a stopper 87.

In order to use the airbrush 2, the user places the container 11 on the junction device 30.

Before being put into place on the airbrush, the container 11 is provided with closure means 120, such as a teat or a closure cap, for example, which closure means must thus be removed from the container.

When said junction device is pre-fastened on the airbrush 2, in order to avoid the composition flowing out of the container 11 while it is being inserted into the junction device 30, said airbrush is disposed upsidedown, the opening 90 of the container 11 being directed upwards, and then the container is pushed into the housing 36 until the collar 67 snap-fastens behind the gasket 60. The user may then turn the airbrush 2 over into its normal working position. The absence of a vent in the container avoids composition flowing out while the airbrush is not operating.

While the airbrush is not being used and compressed air is not flowing through the outlet duct (not shown) of the airbrush, the composition thus remains contained within the container 11 without flowing out, because of the suction existing above the level of the composition inside the container 11.

While the airbrush 2 is operating, the suction created at the composition outlet 35 causes the container to empty. Air is taken in via the air-intake channel 80.

When the container 11 is not completely empty, but only little composition remains, accidental air intake is likely to occur even when the airbrush 2 is not operating. In this circumstance, a flow of composition takes place in the air-intake channel 80, but the flow does not lead to composition leaking out from the junction device 30 as a result of the air entry 82 being situated at a sufficiently high level that is higher than the level of the composition remaining in the container.

Figure 6:
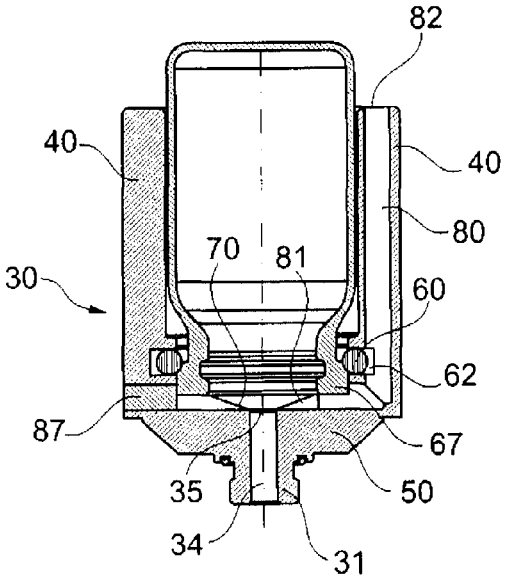
FIGS. 6 to 9 are views similar to FIG. 5 of variant embodiments of the junction device.
Figure 7:
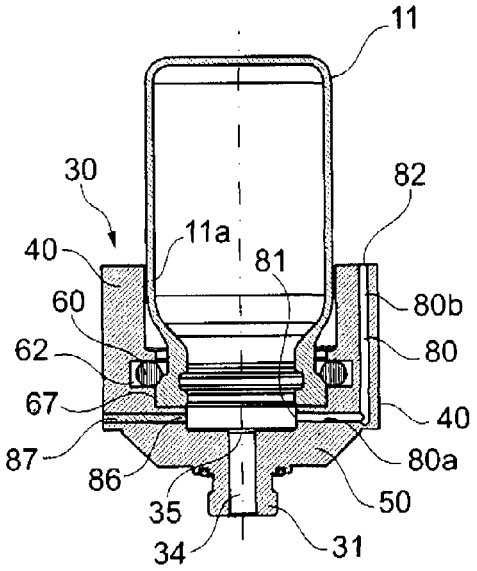

FIG. 6 shows a variant embodiment of the junction device 30 in which the air-entry orifice 82 opens out at the top end of the junction device 30. The same applies in the FIG. 7 embodiment. In this embodiment, the uprights 40 are shorter than the uprights in FIGS. 4 to 6. It is preferable that the height of the upright(s) 40 is sufficient for the air entry 82 to be situated above the level of the neck of the container, e.g. level with a greatest-diameter cylindrical portion 11*a* of the container.

Figure 8:
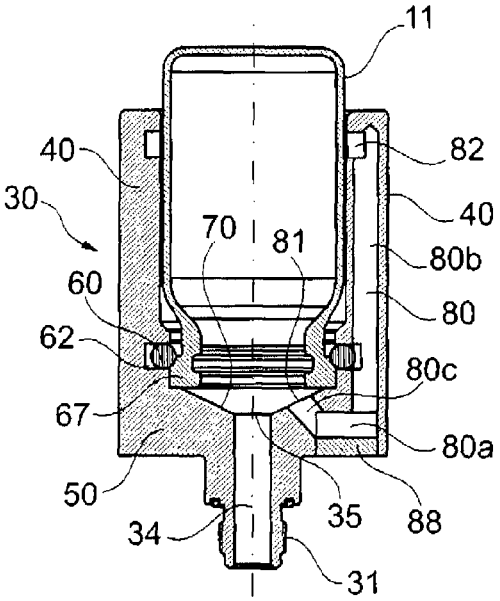

FIG. 8 shows another embodiment of the air-intake channel 80. In this embodiment, the channel includes a segment 80*b*, parallel to the axis X, that is connected via a segment 80*a* to a sloping segment 80*c* that opens out into the housing 36, the segments 80*b* and 80*c* being molded or machined in a portion of the junction device 30 that is made as a single part. A passage in the base 50 is used for forming the segments 80*b* and 80*c*, e.g. by machining or by molding. The passage is then closed, in part, by a separate stopper 88, and defines the portion 80*a*.

In the embodiments in FIGS. 1 to 8, the container 11 includes an opening that is made to be completely free when it is in place on the junction device by removing the closure means 120 that are present on the body of the container 11 before it is put into place on the airbrush 2. By way of example, the closure means 120 are fastened by snap-fastening on the container 11.

In a variant embodiment of the invention, the airbrush 2 includes perforator means that create openings through the closure means 120, in particular an opening that enables the composition to be taken, and an opening that enables air to be taken in. This is particularly advantageous for sealed bottles, e.g. bottles containing a composition that must not be exposed to air before use, or a composition that is particularly soiling.

Figure 9:
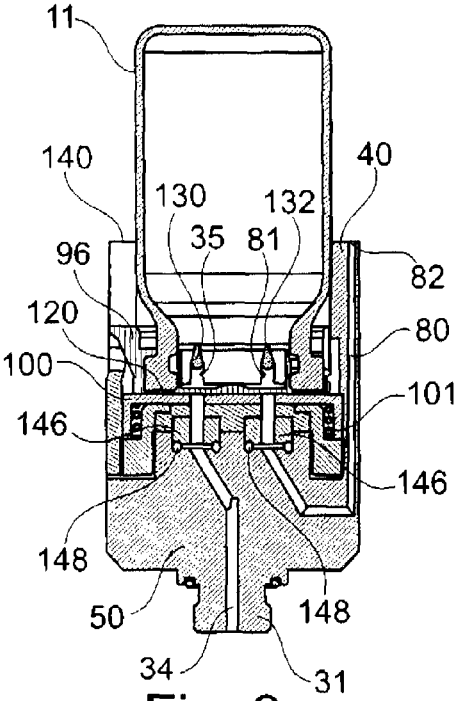
Figure 10:
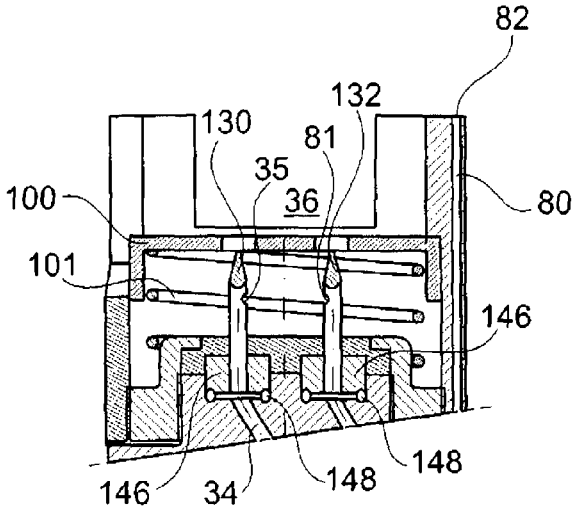
FIG. 10 is a diagrammatic and fragmentary larger-scale view of the FIG. 9 junction, with the container removed.

Thus, FIGS. 9 and 10 show an embodiment in which the airbrush 2 includes two hollow needles 130 and 132, that perforate the closure means 120 of the container 11 when said container is put into place on the junction device 30. By way of example, and as shown, the two needles 130 and 132 present side openings that define the composition outlet 35 and the air inlet 81 respectively. The needles communicate with the composition-taking channel 34 and with the air-intake channel 80 respectively.

By way of example, the needles 130 and 132 present an outside diameter that is compatible with the section of the orifices 35 and 81.

In order to ensure leaktight communication with the channels 34 and 80, the needles 130 and 132 may be inserted in leaktight manner in rings 146 having their bottom walls bearing against O-rings 148 in housings having the channels 34 and 80 opening out into their bottom walls.

In the embodiment shown, the needles 130 and 132 are approximately of the same height, which corresponds to a preferred embodiment. It is not beyond the ambit of the invention for the composition-taking needle 130 to be longer or shorter than the needle 132 connected to the air-intake channel 80.

So as to reduce the risk of injury to the user, a retractable protective member 100 may be disposed inside the housing 36, the protective member 100 being capable, in the absence of a container 11, of taking up a first position in which it extends above the ends of the needles 130 and 132, as shown in FIG. 10, and a lower second position, as shown in FIG. 9, when the container is put into place, so as to enable the needles 130 and 132 to pass through the closure means 120. The protective member 100 is returned into the first position by a spring 101.

By way of example, the upright 40 through which the air-intake channel passes is made integrally with the base 50, as shown. A groove 140 may be provided so as to pass a lug 96 of the closure means 120 while the container is being put into place in the housing 36.

In another embodiment that is not shown, all of the uprights 40 are made as a single part that is fitted on the base 50. Naturally, other configurations are possible.

Figure 13:
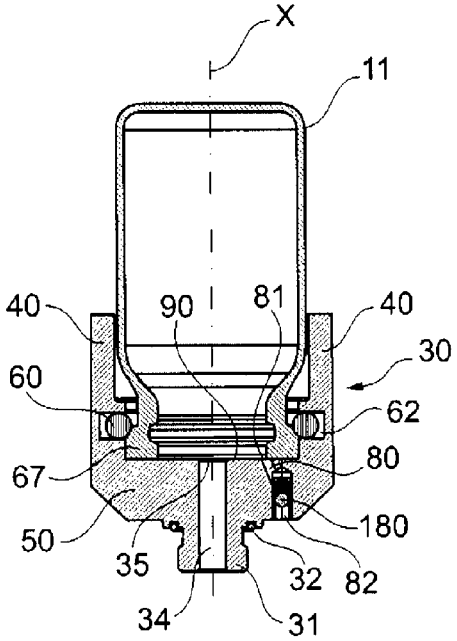
FIG. 13 is a view similar to FIG. 5 showing a variant embodiment in accordance with other exemplary embodiments of the invention.

In the embodiment shown in FIG. 13, the air-entry orifice 82 is situated beneath the base 50. In order to avoid composition leaking, e.g. during manipulations of the container, the air-intake channel 80 may thus include a valve 180, as shown, e.g. a ball valve.

The airbrush 2 may include any trigger means for triggering spraying, e.g. in the form of a control member such as a lever 13, as shown in FIG. 14, that is actuated using one of the fingers of the user's hand that is holding the airbrush. In this figure, the airbrush is a gravity airbrush. It is not beyond the ambit of the invention for a suction feed airbrush to be used. For a suction feed airbrush, it suffices for the junction device 30 to be provided with a system (e.g. a tube 200 as shown by dashed lines in FIG. 1) for putting the outlet orifice 35 into communication with the inlet of the airbrush, thereby enabling suction.

Examples of airbrushes to which the invention may apply and that may be mentioned are the airbrush referenced A 4700 from the supplier Azteck, the airbrush referenced Kustom micron CM from the supplier Iwata, and the airbrush referenced Evolution Infiniti 2 in 1 from the supplier Harder and Steenbeck, those airbrushes being of the type held like a pen. The airbrush referenced Kustom revolution TR from Iwata, or the airbrush referenced Colani® from Harder and Steenbeck may equally well be used.

Naturally, configurations other than the configurations described above are possible. For example, a single compressor may be used with a plurality of airbrushes, e.g. the compressor being situated outside the room in which the treatment is performed so as to reduce noise nuisance.

Preferably, the spray is circular, but various nozzles may be used so as to have sprays that are flat or that have some other shape.

The compressor may be replaced by a supply of compressed air, e.g. compressed air in a cylinder, or a cartridge of compressed or liquefied gas, e.g. carried on the airbrush and manipulated together with said airbrush during use.

A plurality of containers may be mounted on the airbrush, where appropriate.

The compositions contained in the containers used with a system of the invention are preferably for treating the hair and/or the scalp, and usable in rinsed or non-rinsed mode.

In particular, the composition may be chosen from compositions for caring for or treating the scalp, such as anti-dandruff agents, anti-hairloss or hair-regrowth agents, anti-seborrhoea agents, anti-inflammatory agents, anti-irritants or soothing agents, concealers, or agents for stimulating or protecting the scalp, the composition being cosmetic or dermatological.

In a variant, the composition may be a composition for treating the hair; by way of treatment, mention may be made of: washing the hair; caring for or conditioning the hair; temporarily shaping or holding the hair; temporarily, semi-permanently, or permanently dyeing the hair; defrizzing or perming the hair.

The composition may be an optionally-rinsable composition for applying before or after shampooing, dyeing, color stripping, perming, or defrizzing the hair.

When the composition is an anti-hairloss composition or a composition for stimulating hair regrowth, the surface to be treated is localized to the zones in which baldness (in particular male pattern baldness) appears most often, in particular the crown and the temples.

The composition may be sprayed onto zones of the head that do not have hair.

The Composition for Spraying may Contain at Least One Compound Selected From:

Anti-Seborrheic Compounds

The term "anti-seborrheic compound" means a compound that is capable of controlling the activity of the sebaceous glands.

An anti-seborrheic compound that is suitable for the invention may in particular be selected from: retinoic acid; benzoyl peroxide; sulfur; vitamin B6 (or pyridoxine); selenium chloride; sea fennel; mixtures of cinnamon, tea, and octanoylglycine extracts such as Sepicontrol A5 TEA® from the supplier Seppic; mixture of cinnamon, sarcosine, and octanoylglycine, sold in particular by the supplier SEPPIC under the trade name Sepicontrol A5®; zinc salts such as zinc gluconate, zinc pyrrolidonecarboxylate (or zinc pidolate), zinc lactate, zinc aspartate, zinc carboxylate, zinc salicylate, zinc cysteate; copper derivatives and in particular copper pidolate such as Cuivridone® by Solabia; extracts of plants of the species *Arnica montana, Cinchona succirubra, Eugenia caryophyllata, Humulus lupulus, Hypericum perforatum, Mentha piperita, Rosmarinus officinalis, Salvia officinalis*, and *Thymus vulgaris*, all sold for example by the supplier MARUZEN; extracts of meadowsweet (*spiraea ulamaria*) such as that sold under the trade name Sebonormine® by the supplier Silab; extracts of *Laminaria saccharina* (kelp) such as that sold under the trade name Phlorogine® by the supplier Biotechmarine; mixtures of extracts of burnet (*Sanguisorba officinalis/Poterium officinale*) roots, ginger (*Zingiber officinalis*) rhizomes, and cinnamon (*Cinnamomum cassia*) bark such as that sold under the trade name Sebustop® by the supplier Solabia; linseed extracts such as that sold under the trade name Linumine® by the supplier Lucas Meyer; Phellodendron extracts such as those sold under the trade name Phellodendron extract BG by the supplier Maruzen or Oubaku liquid B by the supplier Ichimaru Pharcos; mixtures of argan oil, of *Serenoa serrulata* (saw palmetto) extract, and of sesame seed extract, such as that sold under the trade name Regu SEB® by the supplier Pentapharm; mixtures of extracts of willow herb, *Terminalia chebula*, nasturtium and bioavailable zinc (microalgae) such as that sold under the trade name Seborilys® by the supplier Green tech; extracts of *Pygeum afrianum* such as that sold under the trade name *Pygeum afrianum* sterolic lipid extract by the supplier Euromed; extracts of *Serenoa serrulata* such as those sold under the trade name Viapure Sabal by the supplier Actives International, or those sold by the supplier Euromed; mixtures of extracts of plantain, *Berberis aquifolium*, and sodium salicylate such as that sold under the trade name Seboclear® by the supplier Rahn; clove extract such as that sold under the trade name Clove extract Powder by the supplier Maruzen; argan oil such as that sold under the trade name Lipofructyl® by Laboratoires Serobiologiques; lactic protein filtrates such as that sold under the trade name Normaseb® by the supplier Sederma; extracts of the alga *Laminaria*, such as that sold under the trade name Laminarghane® by the supplier Biotechmarine; oligosaccharides of the alga *Laminaria digitata* such as that sold under the trade name Phycosaccharide AC by the supplier Codif; extracts of cane sugar, such as that sold under the trade name Policasonol® by the supplier Sabinsa; sulfonated schist oil such as that sold under the trade name Ichtyol Pale® by the supplier Ichthyol; meadowsweet (*spiraea ulmaria*) extracts such as that sold under the trade name Cytobiol® Ulmaire by the supplier Libiol; sebacic acid, in particular sold in the form of a sodium polyacrylate gel under the trade name Sebosoft® by the supplier Sederma; glucomannans extracted from konjac tuber and modified with alkyl sulfonate chains, such as that sold under the trade name Biopol Beta by the supplier Arch Chemical; extracts of *Sophora angustifolia*, such as those sold under the trade name *Sophora* powder or *Sophora* extract by the supplier Bioland; extracts of *Cinchona succirubra* bark such as that sold under the trade name Red bark HS by the supplier Alban Muller; extracts of *Quillaja saponaria* such as that sold under the trade name Panama wood HS by the supplier Alban Muller; glycine grafted onto an undecylenic chain or onto a octanoyl chain, such as that sold under the trade name Lipacide UG OR, Lipacide $C_8G$ by the supplier Seppic; oleanolic acid and nordihydroguaiaretic acid mixture such as that sold in the form of a gel under the trade name AC.Net by the supplier Sederma; phthalimidoperoxyhexanoic acid; ($C_{12}$-$C_{13}$)trialkyl citrate sold under the trade name COSMACOL® ECI by the supplier Sasol; ($C_{14}$-$C_{15}$)trialkyl citrate sold under the trade name COSMACOL® ECL by the supplier Sasol; 10-hydroxydecanoic acid, and in particular mixtures of 10-hydroxydecanoic acid, sebacic acid, and 1,10-decanediol, such as that sold under the trade name Acnacidol® BG by the supplier Vincience; yeast protein hydrolysates such as ASEBIOL LS by COGNIS (mixed with vitamins); and mixtures thereof.

Anti-Dandruff Compounds

The term "anti-dandruff compound" means a compound that is capable of preventing the appearance of dandruff, of reducing the amount thereof, and/or of making it disappear completely.

An anti-dandruff compound that is suitable for the invention may in particular be selected from:

- derivatives of 1-hydroxy-2-pyridone such as 1-hydroxy-4-methyl-2-pyridone, 1-hydroxy-6-methylpyridone, 1-hydroxy-4,6-dimethyl-2-pyridone, 1-hydroxy-4-methyl-6-(2,4,4-trimethylpentyl)-2-pyridone, 1-hydroxy-4-methyl-6-cyclohexyl-2-pyridone, 1-hydroxy-4-methyl-6-(methyl-cyclohexyl)2-pyridone, 1-hydroxy-4-methyl-6-(2-bicyclo[2,2,1]heptyl)-2-pyridone, 1-hydroxy-4-methyl-6(4-methylphenyl)-2-pyridone, 1-hydroxy-4-methyl-6[1-[4-nitrophenoxy]-butyl]-2-pyridone, 1-hydroxy-4-methyl-6-(4-cyanophenoxymethyl-2-pyridone), 1-hydroxy-4-methyl-6-(phenylsulfonylmethyl)-2-pyridone, 1-hydroxy-4-methyl-6-(4-bromobenzyl)-2-pyridone and salts thereof; By way of preferred derivative of 1-hydroxy-2-pyridone, mention may be made of the composition sold by HOECHST under the trade name octopyrox (1-hydroxy-4-methyl-6-(2,4,4-trimethylpenthyl)-2-pyridone, monoethanolamine salt;
- pyridinethione salts, in particular calcium, magnesium, barium, strontium, zinc, cadmium, tin, and zirconium salts. Zinc pyridinethione salt is particularly preferred. Zinc pyridinethione salt is sold in particular under the trade name zinc omadine by OLIN;

trihalogeno carbamide of formula:

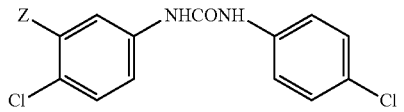

in which Z represents a halogen atom such as chlorine or a $C_1$-$C_4$ trihalogenoalkyl group such as $CF_3$;

triclosan represented by the formula:

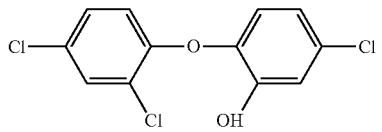

azole compounds such as climbazole, ketoconazole, clotrimazole, econazole, isoconazole, and miconazole;

anti-fungal polymers such as amphotericin B or nystatin;

selenium sulfides, in particular those of formula $S_xSe_{8-x}$, in which x lies in the range 1 to 7;

sulfur in its various forms, cadmium sulfide, allantoin, coal or wood tars, and derivatives thereof, in particular juniper tar oil, salicylic acid, undecylenic acid, fumaric acid, allylamines such as terbinafine;

ellagic acid; and selenium disulfide.

Compounds Promoting the Growth of Human Keratinous Fibers and/or Limiting Loss Thereof and/or Promoting an Increase in Their Density.

These additional compounds are selected in particular from: lipoxygenase inhibitors as described in EP 0 648 488; bradykinin inhibitors described in particular in EP 0 845 700; prostaglandins and derivatives thereof, in particular those described in WO 98/33497, WO 95/11003, JP 97-100091, JP 96-134242; agonists or antagonists of prostaglandin receptors; non-prostanoic analogs of prostaglandins as described in EP 1 175 891 and EP 1 175 890, WO 01/74307, WO 01/74313, WO 01/74314, WO 01/74315, or WO 01/72268; and mixtures thereof.

Other additional active compounds promoting the growth of keratinous fibers and/or limiting loss thereof (in particular the hair or the eyelashes) that may be present in the composition of the invention and that may be mentioned are: vasodilators; anti-androgens; cyclosporins and analogs thereof; anti-microbial and anti-fungal agents; anti-inflammatory agents; and retinoids; alone or in a mixture.

Vasodilators that are suitable for use are in particular potassium-channel agonists including minoxidil and compounds described in U.S. Pat. Nos. 3,382,247, 5,756,092, 5,772,990, 5,760,043, 5,466,694, 5,438,058, 4,973,474, cromakalim, nicorandil, and diaxozide, alone or in combination.

Nicotinic acid esters, including in particular tocopheryl nicotinate, benzyl nicotinate, and $C_1$-$C_6$ alkyl nicotinates such as methyl nicotinate or hexyl nicotinate may be used as vasodilators.

Anti-androgens that are suitable for use include, in particular, steroidal or non-steroidal 5α-reductase inhibitors, such as finasteride and the compounds described in U.S. Pat. No. 5,516,779, cyprosterone acetate, azelaic acid and salts and derivatives thereof, and the compounds described in U.S. Pat. No. 5,480,913, flutamide, oxendolone, spironolactone, diethylstilbestrol, and the compounds described in U.S. Pat. Nos. 5,411,981, 5,565,467, and 4,910,226.

The anti-inflammatory agents may be selected from: steroidal anti-inflammatory agents such as glucocorticoids, corticosteroids (e.g. hydrocortisone); and non-steroidal anti-inflammatory agents such as glycyrrhetinic acid and α-bisabolol, benzydamine, salicylic acid, and the compounds described in EP 0 770 399, WO 94/06434, and FR 2 268 523.

Retinoids may be selected from retinoic acid, isotretinoin, acitretin, tazarotene, retinal, and adapalene.

Other active compounds for promoting growth and/or limiting loss of keratinous fibers such as the hair and the eyelashes that may be mentioned are: aminexil; 6-0-[(9Z, 12Z)-octadeca-9,12-dienoyl]hexapyranose; benzalkonium chloride; benzethonium chloride; phenol; oestradiol; chlorpheniramine maleate; chlorophylline derivatives; cholesterol; cysteine; methionine; arginine; menthol; peppermint oil; calcium pantothenate; panthenol; resorcinol; protein kinase C activators; glycosidase inhibitors; glycosaminoglycanase inhibitors; pyroglutamic acid esters; hexosaccharidic or acylhexosaccharidic acids; substituted arylethylenes; N-acylamino acids; flavonoids; ascomycin derivatives and analogs; histamine antagonists; saponins; proteoglycanase inhibitors; oestrogen agonists and antagonists; pseudoterines; cytokines and growth factor promoters; inhibitors of IL-1 or of IL-6; IL-10 promoters; TNF inhibitors; benzophenones and hydantoin; vitamins such as vitamin D; vitamin B12 analogs; panthenol; vitamin B8; triterpenes such as ursolic acid and the compounds described in U.S. Pat. No. 5,529,769, U.S. Pat. No. 5,468,888, U.S. Pat. No. 5,631,282; anti-pruriginous agents such as thenaldine, trimeprazine, or cyproheptadine; anti-parasitic agents, in particular metronidazole, crotamiton, or pyrethrinoids; calcium antagonist agents such as cinnarizine, diltiazem, nimodipine, verapamil, alverine, and nifedipine; hormones such as estriol or analogs thereof, thyroxine and salts thereof, progesterone; FP receptor (type F prostaglandin receptor) antagonists such as latanoprost, (5E)-7-{(1R,2R,3R,5S)-3,5-dihydroxy-2-[(3R)-3-hydroxy-5-phenyl pentyl]cyclopentyl}hept-5-enoic acid, bimatoprost, travoprost, unoprostone, and butaprost; O-acyl derivatives obtained by partial or total esterification of vitamin F by glucose, as described in application EP 1 688 128; 15-hydroxy prostaglandin dehydrogenase inhibitors; and mixtures thereof.

Other active compounds for promoting growth and/or limiting loss of keratinous fibers such as the hair and the eyelashes, that are suitable for use in combination with the compound of formula (I) and that may be mentioned are: pyridine dicarboxylate derivatives or a salt thereof such as those described in application EP 1 352 629 and more particularly diethyl pyridine-2,4-dicarboxylate.

Other than the above-mentioned anti-inflammatory agents, anti-irritant/soothing active agents that may be mentioned are: strontium salts, β-glycyrrhetinic acid, glycyrrhizic acid, azulene, essential oils, extracts of chamomile, oats, aloe vera, verbena, tilia, and licorice.

Hair Dyes

In the meaning of the present invention, the term "hair dye" means synthetic direct dyes, natural dyes, and oxidation dye precursors.

These hair dyes may be nonionic or ionic, in particular cationic or anionic.

The oxidation dye precursor(s) present in the composition of the present invention may be chosen from the oxidation bases and couplers conventionally used in oxidation dyeing.

The oxidation base(s) may be chosen from para-phenylenediamines, bis(phenyl)alkylenediamines, para-aminophenols, bis-para-aminophenols, ortho-aminophenols, ortho-phenylenediamines, and heterocyclic bases, and the addition salts thereof.

Among the para-phenylenediamines, examples that may be mentioned include para-phenylenediamine, para-toluenediamine, 2-chloro-para-phenylenediamine, 2,3-dimethyl-para-phenylenediamine, 2,6-dimethyl-para-phenylenediamine, 2,6-diethyl-para-phenylenediamine, 2,5-dimethyl-para-phenylenediamine, N,N-dimethyl-para-phenylenediamine, N,N-diethyl-para-phenylenediamine, N,N-dipropyl-para-phenylenediamine, 4-amino-N,N-diethyl-3-methylaniline, N,N-bis(β-hydroxyethyl)-para-phenylenediamine, 4-N,N-bis(β-hydroxyethyl)amino-2-methylaniline, 4-N,N-bis(β-hydroxyethyl)amino-2-chloroaniline, 2-β-hydroxyethyl-para-phenylenediamine, 2-fluoro-para-phenylenediamine, 2-isopropyl-para-phenylenediamine, N-(β-hydroxypropyl)-para-phenylenediamine, 2-hydroxymethyl-para-phenylenediamine, N,N-dimethyl-3-methyl-para-phenylenediamine, N-ethyl-N-(β-hydroxyethyl)-para-phenylenediamine, N-(β,γ-dihydroxypropyl)-para-phenylenediamine, N-(4'-aminophenyl)-para-phenylenediamine, N-phenyl-para-phenylenediamine, 2-β-hydroxy-ethyloxy-para-phenylenediamine, 2-β-acetylaminoethyloxy-para-phenylenediamine, N-(β-methoxyethyl)-para-phenylenediamine, 4-aminophenylpyrrolidine, 2-thienyl-para-phenylenediamine, 2-β-hydroxyethylamino-5-aminotoluene and 3-hydroxy-1-(4'-aminophenyl)pyrrolidine, and the addition salts thereof.

Among the para-phenylenediamines mentioned above, para-phenylenediamine, para-toluenediamine, 2-isopropyl-para-phenylenediamine, 2-β-hydroxyethyl-para-phenylenediamine, 2-β-hydroxyethyloxy-para-phenylenediamine, 2,6-dimethyl-para-phenylenediamine, 2,6-diethyl-para-phenylenediamine, 2,3-dimethyl-para-phenylenediamine, N,N-bis(β-hydroxyethyl)-para-phenylenediamine, 2-chloro-para-phenylenediamine and 2-β-acetylaminoethyloxy-para-phenylenediamine, and the addition salts thereof, are particularly preferred.

Among the bis(phenyl)alkylenediamines, examples that may be mentioned include N,N'-bis(β-hydroxyethyl)-N,N'-bis(4'-aminophenyl)-1,3-diaminopropanol, N,N'-bis(β-hydroxyethyl)-N,N'-bis(4'-aminophenyl)ethylenediamine, N,N'-bis(4-aminophenyl)tetramethylenediamine, N,N'-bis(β-hydroxyethyl)-N,N'-bis(4-aminophenyl)tetramethylenediamine, N,N'-bis(4-methylaminophenyl)tetramethylenediamine, N,N'-bis(ethyl)-N,N'-bis(4'-amino-3'-methylphenyl)ethylenediamine and 1,8-bis(2,5-diaminophenoxy)-3,6-dioxaoctane, and the addition salts thereof.

Among the para-aminophenols, examples that may be mentioned in particular include para-aminophenol, 4-amino-3-methylphenol, 4-amino-3-fluorophenol, 4-amino-3-hydroxymethylphenol, 4-amino-2-methylphenol, 4-amino-2-hydroxymethylphenol, 4-amino-2-methoxymethylphenol, 4-amino-2-aminomethylphenol, 4-amino-2-β-hydroxyethylaminomethyl)phenol and 4-amino-2-fluorophenol, and the addition salts thereof.

Among the ortho-aminophenols, examples that may be mentioned include 2-aminophenol, 2-amino-5-methylphenol, 2-amino-6-methylphenol and 5-acetamido-2-aminophenol, and the addition salts thereof.

Among the heterocyclic bases, examples that may be mentioned include pyridine derivatives, pyrimidine derivatives and pyrazole derivatives.

Among the pyridine derivatives that may be mentioned are the compounds described, for example, in patents GB 1 026 978 and GB 1 153 196, for instance 2,5-diaminopyridine, 2-(4-methoxyphenyl)amino-3-aminopyridine, 2,3-diamino-6-methoxypyridine, 2-(β-methoxyethyl)amino-3-amino-6-methoxypyridine and 3,4-diaminopyridine, and the addition salts thereof.

Other pyridine oxidation bases that are useful in the present invention are the 3-aminopyrazolo[1,5-a]-pyridine oxidation bases or addition salts thereof described, for example, in patent application FR 2 801 308. Examples that may be mentioned include pyrazolo[1,5-a]pyrid-3-ylamine, 2-acetylaminopyrazolo-[1,5-a]pyrid-3-ylamine, 2-morpholin-4-ylpyrazolo[1,5-a]pyrid-3-ylamine, 3-aminopyrazolo[1,5-a]pyridine-2-carboxylic acid, 2-methoxypyrazolo[1,5-a]pyrid-3-ylamine, (3-aminopyrazolo[1,5-a]pyrid-7-yl)methanol, 2-(3-aminopyrazolo[1,5-a]pyrid-5-yl)ethanol, 2-(3-aminopyrazolo[1,5-a]pyrid-7-yl)ethanol, (3-aminopyrazolo[1,5-a]pyrid-2-yl)methanol, 3,6-diaminopyrazolo[1,5-a]pyridine, 3,4-diaminopyrazolo[1,5-a]pyridine, pyrazolo-[1,5-a]pyridine-3,7-diamine, 7-morpholin-4-ylpyrazolo[1,5-a]pyrid-3-ylamine, pyrazolo[1,5-a]pyridine-3,5-diamine, 5-morpholin-4-ylpyrazolo[1,5-a]pyrid-3-ylamine, 2-[(3-aminopyrazolo[1,5-a]pyrid-5-yl)(2-hydroxyethyl)amino]ethanol, 2-[(3-aminopyrazolo[1,5-a]pyrid-7-yl)(2-hydroxyethyl)amino]ethanol, 3-aminopyrazolo[1,5-a]pyridin-5-ol, 3-aminopyrazolo[1,5-a]-pyridin-4-ol, 3-aminopyrazolo[1,5-a]pyridin-6-ol and 3-aminopyrazolo[1,5-a]pyridin-7-ol, and the addition salts thereof.

Among the pyrimidine derivatives that may be mentioned are the compounds described, for example, in patents DE 2 359 399, JP 88-169 571, JP 05-63124, EP 0 770 375, or patent application WO 96/15765, for instance 2,4,5,6-tetraaminopyrimidine, 4-hydroxy-2,5,6-triaminopyrimidine, 2-hydroxy-4,5,6-triaminopyrimidine, 2,4-dihydroxy-5,6-diaminopyrimidine and 2,5,6-triaminopyrimidine, pyrazolopyrimidine derivatives such as those mentioned in patent application FR-A-2 750 048, and among which mention may be made of pyrazolo[1,5-a]pyrimidine-3,7-diamine, 2,5-dimethylpyrazolo[1,5-a]pyrimidine-3,7-diamine, pyrazolo[1,5-a]pyrimidine-3,5-diamine, 2,7-dimethylpyrazolo[1,5-a]pyrimidine-3,5-diamine, 3-aminopyrazolo[1,5-a]pyrimidin-7-ol, 3-aminopyrazolo[1,5-a]pyrimidin-5-ol, 2-(3-aminopyrazolo[1,5-a]pyrimidin-7-ylamino)ethanol, 2-(7-aminopyrazolo[1,5-a]pyrimidin-3-ylamino)ethanol, 2-[(3-aminopyrazolo[1,5-a]pyrimidin-7-yl)(2-hydroxyethyl)amino]ethanol, 2-[(7-aminopyrazolo[1,5-a]pyrimidin-3-yl)(2-hydroxyethyl)-amino]ethanol, 5,6-dimethylpyrazolo[1,5-a]pyrimidine-3,7-diamine, 2,6-dimethylpyrazolo[1,5-a]pyrimidine-3,7-diamine, 2,5,N7,N7-tetramethylpyrazolo[1,5-a]pyrimidine-3,7-diamine and 3-amino-5-methyl-7-imidazolyl-propylaminopyrazolo[1,5-a]pyrimidine, and the addition salts thereof, and the tautomeric forms thereof, when a tautomeric equilibrium exists.

Among the pyrazole derivatives that may be mentioned are the compounds described in patents DE 3 843 892 and DE 4 133 957, and patent applications WO 94/08969, WO 94/08970, FR-A-2 733 749 and DE 195 43 988, for instance 4,5-diamino-1-(β-hydroxyethyl)pyrazole, 4,5-diamino-1-methylpyrazole, 3,4-diaminopyrazole, 4,5-diamino-1-(4'-chlorobenzyl)pyrazole, 4,5-diamino-1,3-dimethylpyrazole, 4,5-diamino-3-methyl-1-phenylpyrazole, 4,5-diamino-1-methyl-3-phenylpyrazole, 4-amino-1,3-dimethyl-5-hydrazinopyrazole, 1-benzyl-4,5-diamino-3-methylpyrazole, 4,5-diamino-3-tert-butyl-1-methylpyrazole, 4,5-diamino-1-tert-butyl-3-methylpyrazole, 4,5-diamino-1-(β-hydroxyethyl)-3-methylpyrazole, 4,5-diamino-1-ethyl-3-methylpyrazole, 4,5-diamino-1-ethyl-3-(4'-methoxyphenyl)-pyrazole, 4,5-diamino-1-ethyl-3-hydroxymethylpyrazole, 4,5-diamino-3-hydroxymethyl-1-methylpyrazole, 4,5-diamino-3-hydroxymethyl-1-isopropylpyrazole, 4,5-diamino-3-methyl-1-isopropylpyrazole, 4-amino-5-(2'-aminoethyl) amino-1,3-dimethylpyrazole, 3,4,5-triaminopyrazole, 1-methyl-3,4,5-triaminopyrazole, 3,5-diamino-1-methyl-4-methylaminopyrazole, 3,5-diamino-4-(β-hydroxyethyl) amino-1-methylpyrazole and 2,3-diamino-6,7-dihydro-1H, 5H-pyrazolo[1,2-a]pyrazol-1-one, and the addition salts thereof.

The coupler(s) present in the composition in accordance with the present invention may be chosen from meta-phenylenediamines, meta-aminophenols, meta-diphenols, naphthalene-based couplers and heterocyclic couplers, and the addition salts thereof.

Examples that may be mentioned include 3-aminophenol, 2-methyl-5-aminophenol, 2-methyl-5-(β-hydroxyethyl-amino)phenol, 2-chloro-6-methyl-3-aminophenol, 1,3-dihydroxybenzene, 1,3-dihydroxy-2-methylbenzene, 4-chloro-1, 3-dihydroxybenzene, 2,4-diamino-1-(β-hydroxyethyloxy) benzene, 2-amino-4-(β-hydroxyethylamino)-1-methoxybenzene, 1,3-diaminobenzene, 1,3-bis(2,4-diaminophenoxy)propane, 3-ureidoaniline, 3-ureido-1-dimethylaminobenzene, sesamol, 1-β-hydroxyethylamino-3,4-methylenedioxybenzene, α-naphthol, 2-methyl-1-naphthol, 6-hydroxyindole, 4-hydroxyindole, 4-hydroxy-N-methylindole, 2-amino-3-hydroxypyridine, 6-hydroxybenzomorpholine, 3,5-diamino-2,6-dimethoxy-pyridine, 1-N-(β-hydroxyethyl)-amino-3,4-methylenedioxybenzene, 2,6-bis(β-hydroxyethyl-amino)toluene, and the addition salts thereof.

In general, the addition salts of the oxidation bases and couplers that are suitable for use in the context of the invention are especially chosen from the addition salts with an acid such as the hydrochlorides, hydrobromides, sulfates, citrates, succinates, tartrates, lactates, $(C_1-C_4)$alkylsulfonates, and in particular methanesulfonates, tosylates, benzenesulfonates, phosphates and acetates, and the addition salts with a base such as sodium hydroxide, potassium hydroxide, ammonia, amines, or alkanolamines.

The term "natural dye" means any dye or dye precursor that is naturally occurring and produced either by extraction (and optionally purification) from a plant matrix, or by chemical synthesis.

In contrast, the term "synthetic dye" means any dye that is not naturally occurring.

As examples of synthetic direct dyes that are suitable for use, mention may be made of azo, methine, carbonyl, azine, nitro(hetero)aryl, and tri(hetero)arylmethane direct dyes, alone or as mixtures.

More particularly, the azo dyes comprise an —N═N— function in which the two nitrogen atoms are not simultaneously engaged in a ring. However, it is not excluded for one of the two nitrogen atoms of the sequence —N═N— to be engaged in a ring.

The dyes of the methine family are more particularly compounds comprising at least one sequence selected from >C═C< and —N═C< in which the two atoms are not simultaneously engaged in a ring. However, it is pointed out that one of the nitrogen or carbon atoms of the sequences may be engaged in a ring. More particularly, the dyes of this family are derived from compounds of true methine type (comprising one or more above-mentioned sequences —C═C—); of azomethine type (comprising at least one, or more, sequences —C═N—) with, for example, azacarbocyanins and their isomers, diazacarbocyanins and their isomers, and tetraazacarbocyanins; of mono- and diarylmethane type; of indoamine (or diphenylamine) type; of indophenol type; or of indoaniline type.

As regards the dyes of the carbonyl family, examples that may be mentioned include dyes chosen from acridone, benzoquinone, anthraquinone, naphthoquinone, benzanthrone, anthranthrone, pyranthrone, pyrazol-anthrone, pyrimidinoanthrone, flavanthrone, idanthrone, flavone, (iso) violanthrone, isoindolinone, benzimid-azolone, isoquinolinone, anthrapyridone, pyrazolo-quinazolone, perinone, quinacridone, quinophthalone, indigoid, thioindigo, naphthalimide, anthrapyrimidine, diketopyrrolopyrrole, and coumarin dyes.

As regards the dyes of the azine family, mention may be made especially of azine, xanthene, thioxanthene, fluorindine, acridine, (di)oxazine, (di)thiazine and pyronin dyes.

The nitro(hetero)aromatic dyes are more particularly nitrobenzene or nitropyridine direct dyes.

As regards the dyes of porphyrin or phthalocyanin type, it is possible to use cationic or non-cationic compounds, optionally comprising one or more metals or metal ions, for instance alkali metals, alkaline-earth metals, zinc, and silicon.

Examples of particularly suitable synthetic direct dyes that may be mentioned include nitrobenzene dyes; azo direct dyes; methine direct dyes; azomethine direct dyes, with, more particularly, diazacarbocyanins and isomers thereof and tetraazacarbocyanins (tetraazapentamethines); quinone direct dyes, and in particular anthraquinone, naphthoquinone, or benzoquinone dyes; azine, xanthene, triarylmethane, indoamine, indigoid, phthalocyanin, and porphyrin direct dyes; alone or as mixtures.

The direct dyes are preferably selected from nitrobenzene dyes; azo dyes; azomethine dyes, with diazacarbocyanins and isomers thereof, and tetraazacarbocyanins (tetraazapentamethines); anthraquinone direct dyes; triarylmethane direct dyes; alone or as mixtures.

More preferably still, these direct dyes are selected from nitrobenzene dyes; azo direct dyes; azomethine direct dyes, with diazacarbocyanins and isomers thereof, and tetraazacarbocyanins (tetraazapentamethines); alone or as a mixture.

Among the nitrobenzene direct dyes that are suitable for use in the invention, mention may be made in a non-limiting manner of the following compounds:

1,4-diamino-2-nitrobenzene;
1-amino-2-nitro-4-β-hydroxyethyl)aminobenzene;
1-amino-2-nitro-4-bis(β-hydroxyethyl)aminobenzene;
1,4-bis(β-hydroxyethylamino)-2-nitrobenzene;
1-β-hydroxyethylamino-2-nitro-4-bis(β-hydroxyethyl-amino)benzene;
1-β-hydroxyethylamino-2-nitro-4-aminobenzene;
1-β-hydroxyethylamino-2-nitro-4-(ethyl)(β-hydroxyethyl) aminobenzene;
1-amino-3-methyl-4-β-hydroxyethylamino-6-nitrobenzene;
1-amino-2-nitro-4-β-hydroxyethylamino-5-chlorobenzene;
1,2-diamino-4-nitrobenzene;
1-amino-2-β-hydroxyethylamino-5-nitrobenzene;
1,2-bis(β-hydroxyethylamino)-4-nitrobenzene;
1-amino-2-tris(hydroxymethyl)methylamino-5-nitrobenzene;
1-hydroxy-2-amino-5-nitrobenzene;
1-hydroxy-2-amino-4-nitrobenzene;
1-hydroxy-3-nitro-4-aminobenzene;

1-hydroxy-2-amino-4,6-dinitrobenzene;
1-β-hydroxyethyloxy-2-β-hydroxyethylamino-5-nitrobenzene;
1-methoxy-2-β-hydroxyethylamino-5-nitrobenzene;
1-β-hydroxyethyloxy-3-methylamino-4-nitrobenzene;
1-β,γ-dihydroxypropyloxy-3-methylamino-4-nitrobenzene;
1-β-hydroxyethylamino-4-β,γ-dihydroxypropyloxy-2-nitrobenzene;
1-β,γ-dihydroxypropylamino-4-trifluoromethyl-2-nitrobenzene;
1-β-hydroxyethylamino-4-trifluoromethyl-2-nitrobenzene;
1-β-hydroxyethylamino-3-methyl-2-nitrobenzene;
1-β-aminoethylamino-5-methoxy-2-nitrobenzene;
1-hydroxy-2-chloro-6-ethylamino-4-nitrobenzene;
1-hydroxy-2-chloro-6-amino-4-nitrobenzene;
1-hydroxy-6-bis(β-hydroxyethyl)amino-3-nitrobenzene;
1-β-hydroxyethylamino-2-nitrobenzene;
1-hydroxy-4-β-hydroxyethylamino-3-nitrobenzene.

Among the azo, azomethine, and methine direct dyes that are suitable for use in the invention, mention may be made of the cationic dyes described in patent applications WO 95/15144, WO 95/01772, EP 714 954, FR 2 189 006, FR 2 285 851, FR 2 140 205, EP 1 378 544, and EP 1 674 073.

For example, the synthetic direct dye(s) may be chosen from monochromophoric cationic direct dyes of the following types: azos; methines; azomethines with diazacarbocyanins and isomers thereof, and tetraazacarbocyanins; anthraquinones; alone or as a mixture.

Hence, mention may be made especially of the cationic direct dyes corresponding to the following formulae:

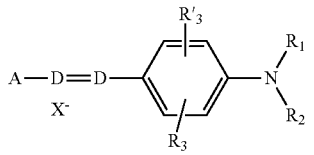

in which:

D represents a nitrogen atom or the —CH group;

$R_1$ and $R_2$, which may be identical or different, represent a hydrogen atom; a $C_1$-$C_4$ alkyl radical which may be substituted with a —CN, —OH or —$NH_2$ radical, or form, with a carbon atom of the benzene ring, an optionally oxygenous or nitrogenous heterocycle that may be substituted with one or more $C_1$-$C_4$ alkyl radicals; a 4'-aminophenyl radical;

$R_3$ and $R'_3$, which are identical or different, represent a hydrogen or halogen atom selected from chlorine, bromine, iodine and fluorine, or a cyano, $C_1$-$C_4$ alkyl, $C_1$-$C_4$ alkoxy or acetyloxy radical;

$X^-$ represents an anion preferably selected from chloride, methyl sulfate and acetate;

A represents a group selected from the following structures:

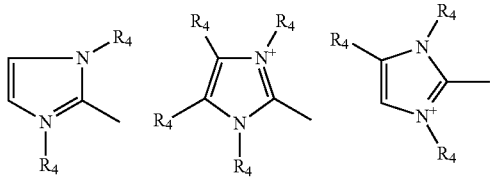

-continued

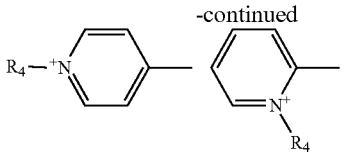

in which:

$R_4$ represents a $C_1$-$C_4$ alkyl radical that may be substituted with a hydroxyl radical;

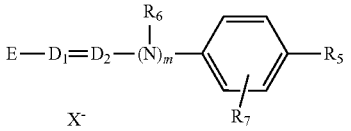

in which:

$R_5$ represents a hydrogen atom, a $C_1$-$C_4$ alkoxy radical or a halogen atom such as bromine, chlorine, iodine, or fluorine;

$R_6$ represents a hydrogen atom or a $C_1$-$C_4$ alkyl radical or forms, with a carbon atom of the benzene ring, a heterocycle that is optionally oxygenous and/or substituted with one or more $C_1$-$C_4$ alkyl groups;

$R_7$ represents a hydrogen or halogen atom such as bromine, chlorine, iodine, or fluorine;

$D_1$ and $D_2$, which may be identical or different, represent a nitrogen atom or the —CH group;

m=0 or 1;

$X^-$ represents a cosmetically acceptable anion that is preferably selected from chloride, methyl sulfate, and acetate;

E represents a group selected from the following structures:

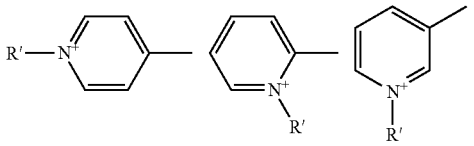

in which:

R' represents a $C_1$-$C_4$ alkyl radical;

when m=0 and when $D_1$ represents a nitrogen atom, E may then also denote a group of the following structure:

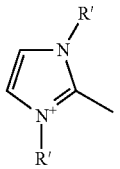

in which:

R' represents a $C_1$-$C_4$ alkyl radical.

Among the above-mentioned compounds, use is made most particularly of the following compounds:

(A1)

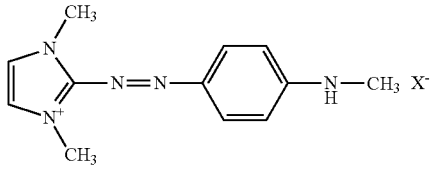

(A2)

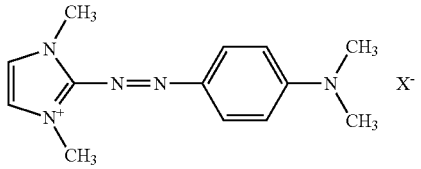

(A3)

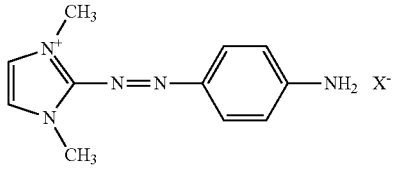

(A4)

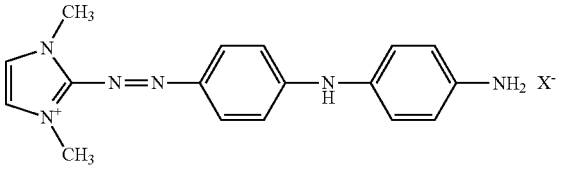

(A5)

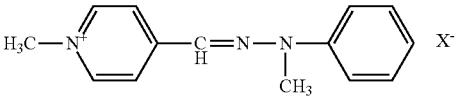

(A6)

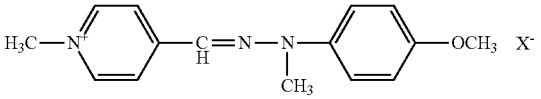

$X^-$ representing a cosmetically acceptable anion or mixture of anions.

As other dyes that are suitable for use in the invention, mention may also be made, among the azo direct dyes, of the following dyes, which are described in the Colour Index International, 3rd edition:

Disperse Red 17
Disperse Red 13
Basic Red 22
Basic Red 76
Basic Yellow 57
Basic Brown 16
Basic Brown 17
Disperse Green 9
Disperse Black 9
Solvent Black 3
Disperse Blue 148
Disperse Violet 63
Solvent Orange 7.

Mention may also be made of 1-(4'-aminodiphenylazo)-2-methyl-4-bis(β-hydroxyethyl)aminobenzene (INCI name: HC Yellow 7).

Among the quinone direct dyes that may be mentioned are the following dyes:

Disperse Red 15
Solvent Violet 13
Solvent Blue 14
Disperse Violet 1
Disperse Violet 4
Disperse Blue 1
Disperse Violet 8
Disperse Blue 3
Disperse Red 11
Disperse Blue 7
Disperse Blue 14
Basic Blue 22
Disperse Violet 15
Disperse Blue 377
Disperse Blue 60
Basic Blue 99 also the following compounds:

1-N-methylmorpholiniumpropylamino-4-hydroxyanthraquinone;
1-aminopropylamino-4-methylaminoanthraquinone;
1-aminopropylaminoanthraquinone;
5-β-hydroxyethyl-1,4-diaminoanthraquinone;
2-aminoethylaminoanthraquinone;
1,4-bis(βγ-dihydroxypropylamino)anthraquinone.

Mention may also be made of the coumarin compound Disperse Yellow 82.

Among the azine dyes that may be mentioned are the following compounds:

Basic Blue 17
Basic Red 2
Solvent Orange 15.

Among the triarylmethane dyes that are suitable for use in the invention, mention may be made of the following compounds:

Basic Green 1
Basic Violet 3
Basic Violet 14
Basic Blue 7
Basic Blue 26

Among the indoamine dyes that are suitable for use in the invention, mention may be made of the following compounds:

2-β-hydroxyethylamino-5-[bis(β-4'-hydroxyethyl)amino]anilino-1,4-benzoquinone;
2-β-hydroxyethylamino-5-(2'-methoxy-4'-amino)anilino-1,4-benzoquinone;
3-N(2'-chloro-4'-hydroxy)phenylacetylamino-6-methoxy-1,4-benzoquinone imine;
3-N(3'-chloro-4'-methylamino)phenylureido-6-methyl-1,4-benzoquinone imine;
3-[4'-N-(ethylcarbamylmethyl)amino]phenylureido-6-methyl-1,4-benzoquinone imine.

The cationic direct dyes are preferably selected from direct dyes of the following types: azos, methines; azomethines, with diazacarbocyanins and isomers thereof, and tetraazacarbocyanins (tetraazapentamethines); anthraquinones; alone or as a mixture.

Among the anionic direct dyes, mention may be made in particular of those described in the Colour Index International 3rd edition under the name Acid, and in particular:

Disperse Red 17
Acid Yellow 9
Acid Black 1
Acid Yellow 36
Acid Orange 7

Acid Red 33
Acid Red 35
Acid Yellow 23
Acid Orange 24
Acid Violet 43
Acid Blue 62
Acid blue 9
Acid Violet 49
Acid Blue 7.

The natural dye(s) that are in particular suitable for use in the invention are preferably chosen from lawsone, juglone, alizarin, purpurin, carminic acid, kermesic acid, laccaic acid, purpurogallin, anthragallol, protocatechaldehyde, indigo, isatin, curcumin, spinulosin, chlorophylls, chlorophyllines, orceins, haematin, haematoxylin, brazilin, brazileine, safflower dyes (for instance carthamine), flavonoids (with, for example, morin, apigenidin and sandalwood), anthocyans (of the apigeninidin type), carotenoids, tannins, sorghum and cochineal carmine, or mixtures thereof.

Extracts or decoctions containing these natural dyes, and especially henna-based extracts, may also be used.

Preferably, the natural dye(s) are chosen from lawsone, juglone, alizarin, purpurin, carminic acid, kermesic acid, laccaic acid, purpurogallin, protocatechaldehyde, indigo, isatin, curcumin, spinulosin, apigenidin, chlorophylline, sorghum, orceins, cochineal carmine, haematin, haematoxylin, brazilin, and brazileine, and mixtures thereof.

These dyes may optionally be used in the presence of mordants (e.g. zinc, manganese, aluminium, iron, etc. salts).

Reducing Agents

Compositions for perming or defrizzing may contain a reducing agent that is capable of reducing the disulfide bonds in hair.

It is possible to use a reducing agent of the phosphine, sulfite, or alkaline bisulfite type. Advantageously, a thiol reducing agent is used.

Preferably, the thiol(s) used as reducing agent(s) in the reducing composition is/are selected from aminothiols such as cysteine and derivatives thereof, such as N-acetylcysteine, cysteamine and derivatives thereof, preferably $C_1$-$C_4$ acyl derivatives thereof, such as N-acetyl cysteamine and N-propionyl cysteamine, and non-amine thiols such as thiolactic acid and esters thereof, such as glycerol monothiolactate, thioglycolic acid and esters thereof, such as glycerol or glycol monothioglycolate, and thioglycerol.

When the thiol possesses at least one carboxylic-acid function, it is possible, where appropriate, to use said thiol in the form of one or more salts thereof, such as alkali-metal or ammonium salts. It is thus possible to use ammonium thioglycolate by way of a thiol. If the thiol possesses an amino group, it is possible, where appropriate, to use said thiol in the form of one or more salts thereof, such as aminothiol halides. In the context of the present invention, it is thus possible to use L-cysteine chlorhydrate as a thiol.

Suitable aminothiols usable in the reducing composition used in the invention that can also be mentioned are N-mercapto alkyl amides of sugars such as N-(mercapto-2-ethyl) gluconamide, pantheteine, N-(mercaptoalkyl)ω-hydroxyalkyl amides, such as those described in patent application EP-A-0 354 835, and N-mono- or N,N-dialkylmercapto 4-butyramides such as those described in patent application EP-A-0 368 763, aminomercaptoalkyl amides, such as those described in patent application EP-A-0 432 000, and alkylaminomercaptoalkylamides, such as those described in patent application EP-A-0 514 282. Among the non-amine thiols used in the invention, mention may also be made of the (2/3) hydroxy-2 propyl thioglycolate and (67/33)hydroxy-2 methyl-1 ethyl thioglycolate-based mixture described in the French patent application No. FR-A-2 679 448, β-mercaptopropionic acid and derivatives thereof, and thiomalic acid.

Preferably, in the invention, a thiol reducing agent is used, in particular thioglycolic acid of cysteine.

For defrizzing, it is also possible to use strong bases such as hydroxides of alkali or alkaline-earth metals, transition metals, and organic hydroxides. Examples of hydroxide compounds that may be mentioned are sodium hydroxide, lithium hydroxide, calcium hydroxide, magnesium hydroxide, barium hydroxide, strontium, hydroxide, manganese hydroxide, zinc hydroxide, and guanidinium hydroxide. The preferred hydroxide compounds are sodium hydroxide, calcium hydroxide, lithium hydroxide, and guanidinium hydroxide.

Conditioning Agents

Compositions for caring for or conditioning the hair contain one or more conditioning agents.

The conditioning agent may be chosen from the group comprising cationic polymers, cationic surfactants, silicones in particular organosiloxanes, linear or branched $C_8$-$C_{30}$ hydrocarbons, linear or branched $C_8$-$C_{30}$ fatty alcohols, esters of a $C_8$-$C_{30}$ fatty acid and of a $C_1$-$C_{30}$ alcohol including esters of a $C_8$-$C_{30}$ fatty acid and of a $C_8$-$C_{30}$ alcohol, esters of a $C_1$-$C_7$ acid or diacid and of a $C_8$-$C_{30}$ fatty alcohol, ceramides or analogs thereof, and mixtures of these compounds.

The term "cationic polymer" means a polymer that is positively charged when it is contained in the composition of the invention. The polymer may carry one or more permanent positive charges or it may contain one or more cationizable functions within the composition of the invention.

Cationic polymers suitable for use as conditioning agents of the present invention are preferably chosen from polymers including primary, secondary, tertiary, and/or quaternary amine groups forming part of the polymer chain or connected directly thereto, and having a molecular weight lying in the range 500 to about 5,000,000 and preferably in the range 1000 to 3,000,000.

When the conditioning agent is a cationic polymer, it is preferably chosen from those that contain motifs comprising primary, secondary, tertiary, and/or quaternary amine groups that may either form part of the main polymer chain or that may be carried by a lateral substituent connected directly thereto.

Among the cationic polymers, mention may be made more particularly of polymers of the quaternary polyamine, polyaminoamide, and polyammonium type. These are known compositions. They are described in French patents Nos. 2 505 348 and 2 542 997, for example.

Among these polymers, mention may be made of:

(1) homopolymers or copolymers derived from acrylic or methacrylic esters or amides and comprising at least one of the motifs having the following formulae:

(I)

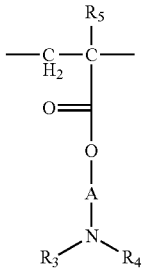

-continued (II)

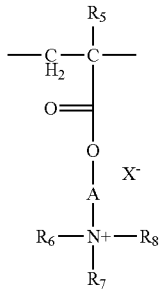

(III)

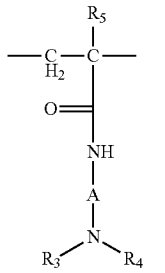

(IV)

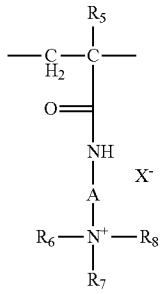

in which:

$R_3$ and $R_4$, which may be identical or different, represent hydrogen or an alkyl group comprising 1 to 6 carbon atoms, for example, methyl or ethyl groups;

$R_5$, which may be identical or different, designate a hydrogen atom or a CH3 radical;

A, which may be identical or different, represents a linear or branched alkyl groups of 1 to 6 carbon atoms, preferably 2 or 3 carbon atoms, or a hydroxyalkyl group of 1 to 4 carbon atoms;

$R_6$, $R_7$, and $R_8$, which may be identical or different, represent alkyl groups having 1 to 18 carbon atoms or a benzyl radical, and preferably an alkyl group having 1 to 6 carbon atoms; and X— is an anion derived from an inorganic or an organic acid, such as a methosulfate anion or an anion chosen from halides such as chloride or bromide.

Copolymers of family (1) may also contain one or more motifs derived from comonomers, which may be chosen from the family of acrylamides, methacrylamides, diacetone acrylamides, acrylamides, and methacrylamides substituted on the nitrogen with at least one group chosen from lower ($C_1$-$C_4$) alkyls, acrylic acids, methacrylic acids, acrylic esters, methacrylic esters, vinyllactams, such as vinylpyrrolidone and vinylcaprolactam, and vinyl esters.

Thus, among these copolymers of family (1), mention may be made of:

the copolymers of acrylamide and of dimethylaminoethyl methacrylate quaternized with dimethyl sulfate or with a dimethyl halide, such as that sold under the name Hercofloc by the supplier Hercules;

the copolymers of acrylamide and of methacryloyloxyethyltrimethylammonium chloride described, for example, in patent application EP-A-080 976 and sold under the name Bina Quat P 100 by the supplier Ciba Geigy;

the copolymers of acrylamide and of methacryloyloxyethyltrimethylammonium methosulfate sold under the name Reten by the supplier Hercules;

quaternized or non-quaternized vinylpyrrolidone/dialkylaminoalkyl acrylate or methacrylate copolymers, such as the products sold under the name "Gafquat" by the supplier ISP, e.g. "Gafquat 734" or "Gafquat 755", or alternatively the products known as "Copolymer 845, 958, and 937". These polymers are described in detail in French patents Nos. 2 077 143 and 2 393 573;

dimethylaminoethyl methacrylate/vinylcaprolactam/vinylpyrrolidone terpolymers, such as the product sold under the name Gaffix VC 713 by the supplier ISP;

vinylpyrrolidone/methacrylamidopropyldimethylamine copolymers, sold in particular under the name Styleze CC 10 by ISP;

quaternized vinylpyrrolidone/dimethylaminopropylmethacrylamide copolymers, such as the product sold under the name "Gafquat HS 100" by the supplier ISP; and crosslinked methacryloyloxy($C_1$-$C_4$)alkyltri($C_1$-$C_4$)alkylammonium salt polymers such as the polymers obtained by homopolymerization of dimethylaminoethyl methacrylate quaternized with methyl chloride, or by copolymerization of acrylamide with dimethylaminoethyl methacrylate quaternized with methyl chloride, the homo- or co-polymerization being followed by crosslinking with an olefinically unsaturated compound, such as methylenebisacrylamide. Use may for example be made of an acrylamide/methacryloyloxyethyltrimethylammonium chloride (20/80 by weight) crosslinked copolymer in the form of a dispersion comprising 50% by weight of the said copolymer in mineral oil. This dispersion is sold under the name of "SALCARE® SC 92" by the supplier Ciba. Use may also be made of a crosslinked homopolymer of methacryloyloxyethyltrimethyl-ammonium chloride for example in dispersion in mineral oil or in a liquid ester. These dispersions are sold under the names of "SALCARE® SC 95" and "SALCARE® SC 96" by the supplier Ciba.

(2) polymers comprising piperazinyl motifs and divalent alkylene or hydroxyalkylene radicals comprising straight or branched chains, optionally interrupted by atoms of oxygen, sulfur, or nitrogen or by aromatic or heterocyclic rings, as well as the oxidation and/or quaternization products of these polymers. Such polymers are described, in particular, in French patents Nos. 2 162 025 and 2 280 361;

(3) water-soluble polyamino amides prepared, in particular, by polycondensation of an acidic compound with a polyamine; these polyamino amides possibly being crosslinked with an epihalohydrin, a diepoxide, a dianhydride, an unsaturated dianhydride, a bis-unsaturated derivative, a bishalohydrin, a bis-azetidinium, a bis-haloacyldiamine, a bisalkyl halide or with an oligomer resulting from the reaction of a difunctional compound, which is reactive with a bishalohydrin, a bis-azetidinium, a bis-haloacyldiamine, a bisalkyl halide, an epihalohydrin, a diepoxide or a bis-unsaturated derivative; the crosslinking agent being used in proportions lying in the range 0.025 mol to 0.35 mol per amine group of the polyamino amide; these polyamino amides possibly being alkylated or, if they include one or more tertiary amine functions, they may be quaternized. Such polymers are described, for example, in French patents Nos. 2 252 840 and 2 368 508;

(4) polyaminoamide derivatives resulting from the condensation of polyalkylene polyamines with polycarboxylic acids followed by alkylation with difunctional agents. Mention may be made, for example, of adipic acid/dialkylaminohydroxyalkyldialkylenetriamine polymers in which the alkyl radical comprises 1 to 4 carbon atoms and is preferably methyl, ethyl, or propyl. Such polymers are described, for example, in French patent No. 1 583 363.

Among these derivatives, mention may be made, more particularly, of the adipic acid/dimethylaminohydroxypropyl/diethylenetriamine polymers sold under the name "Cartaretine F, F4, or F8" by the supplier Sandoz.

(5) polymers obtained by reaction of a polyalkylene polyamine comprising two primary amine groups and at least one secondary amine group with a dicarboxylic acid chosen from diglycolic acids and saturated aliphatic dicarboxylic acids comprising 3 to 8 carbon atoms. The molar ratio between the polyalkylene polyamine and the dicarboxylic acid may lie in the range 0.8:1 to 1.4:1; the polyamino amide resulting therefrom may be reacted with epichlorohydrin in a molar ratio of epichlorohydrin relative to the secondary amine group of the polyamino amide lying in the range 0.5:1 to 1.8:1. Such polymers are described, for example, in U.S. Pat. Nos. 3,227,615 and 2,961,347.

Other polymers of this type are sold in particular under the name "Hercosett 57" by the supplier Hercules Inc. or under the name of "PD 170" or "Delsette 101" by the supplier Hercules, for the adipic acid/epoxypropyl/diethylenetriamine copolymer.

(6) cyclopolymers of alkyldiallylamine or of dialkyldiallylammonium, such as the homopolymers or copolymers comprising, as main constituent of the chain, at least one motif corresponding to formula (V) or (VI):

(V)

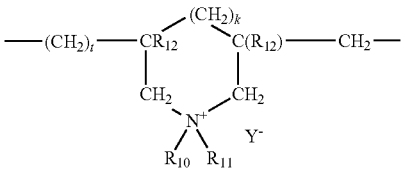

(VI)

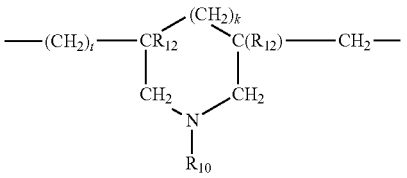

in which:

k and t are equal to 0 or 1, the sum k+t being equal to 1; $R_{12}$ is chosen from a hydrogen atom and a methyl radical; $R_{10}$ and $R_{11}$, which are independent of each other, designate respective alkyl groups comprising 1 to 6 carbon atoms, hydroxyalkyl groups in which the alkyl group preferably comprises 1 to 5 carbon atoms, and lower ($C_1$-$C_4$) amidoalkyl groups, or $R_{10}$ and $R_{11}$ together with the nitrogen atom to which they are attached, may designate heterocyclic groups such as piperidyl or morpholinyl; Y— is an anion such as bromide, chloride, acetate, borate, citrate, tartrate, bisulfate, bisulfite, sulfate, and phosphate. These polymers are described, for example, in French patent No. 2 080 759 and in its Certificate of Addition 2 190 406.

$R_{10}$ and $R_{11}$, which are independent of each other, preferably designate respective alkyl groups comprising 1 to 4 carbon atoms, and more particularly 1 carbon atom.

Among the polymers defined above, mention may be made more particularly of the dimethyldiallylammonium chloride homopolymer sold under the name "Merquat 100" by the supplier Nalco (and its homologues of low weight-average molecular mass) and copolymers of diallyldimethylammonium chloride and of acrylamide sold under the name "Merquat 550".

(7) quaternary diammonium polymers comprising repeating motifs corresponding to the formula (VII):

(VII)

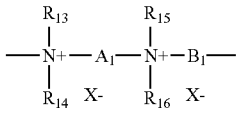

in which:

$R_{13}$, $R_{14}$, $R_{15}$ and $R_{16}$, which may be identical or different, represent aliphatic, alicyclic, or arylaliphatic radicals containing 1 to 20 carbon atoms or lower hydroxyalkylaliphatic radicals, or else $R_{13}$, $R_{14}$, $R_{15}$, and $R_{16}$, together or separately, together with the nitrogen atoms to which they are attached, constitute heterocycles optionally including a second hetero atom other than nitrogen, or else $R_{13}$, $R_{14}$, $R_{15}$, and $R_{16}$ represent linear or branched $C_1$-$C_6$ alkyl radicals substituted with a group chosen from nitrile, ester, acyl, and amide groups, and the groups —CO—O—$R_{17}$-D and —CO—NH—$R_{17}$-D, in which $R_{17}$ is an alkylene group and D is a quaternary ammonium group;

$A_1$ and $B_1$ represent linear or branched, saturated or unsaturated polymethylene groups comprising 2 to 20 carbon atoms, and possibly containing, linked to or intercalated in the main chain, at least one entity chosen from aromatic rings, oxygen and sulfur atoms, and sulfoxide, sulfone, disulfide, amino, alkylamino, hydroxyl, quaternary ammonium, ureido, amide, and ester groups; and X— designates an anion derived from an inorganic or an organic acid;

$A_1$, $R_{13}$, and $R_{15}$ may form, together with the two nitrogen atoms to which they are attached, a piperazine ring; in addition, if $A_1$ is a radical chosen from linear or branched, saturated or unsaturated alkylene or hydroxyalkylene radicals, $B_1$ may also designate a (CH2)n-CO-D-OC—(CH2)p-group, n and p are integers in the range about 2 to 20 where D designates:

a) a glycol residue of formula: —O—Z—O—, where Z designates a linear or branched hydrocarbon radical or a group corresponding to one of the following formulae:

—(CH2-CH2-O)x-CH2-CH2-

—[CH2-CH(CH3)-O]y-CH2-CH(CH3)- wherein x and y are each an integer lying in the range 1 to 4, representing a defined and unique degree of polymerization or any number lying in the range 1 to 4 representing an average degree of polymerization;

b) a bis-secondary diamine residue such as a piperazine derivative;

c) a bis-primary diamine residue of formula: —NH—Y—NH—, where Y designates a linear or branched hydrocarbon radical, or the divalent radical

—CH2-CH2-S—S—CH2-CH2-;

d) a ureylene group of formula: —NH—CO—NH—.

Preferably, X— is an anion such as chloride or bromide.

These polymers may have a number-average molecular mass lying in the range 1000 to 100,000.

These polymers are described, for example, in French patents Nos. 2 320 330, 2 270 846, 2 316 271, 2 336 434, and 2 413 907, and in U.S. Pat. Nos. 2,273,780, 2,375,853, 2,388,614, 2,454,547, 3,206,462, 2,261,002, 2,271,378, 3,874,870, 4,001,432, 3,929,990, 3,966,904, 4,005,193, 4,025,617, 4,025,627, 4,025,653, 4,026,945, and 4,027,020.

More particularly it is possible to use polymers that are constituted by repeating motifs corresponding to the formula:

(VIII)

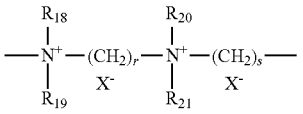

in which:

$R_{18}$, $R_{19}$, $R_{20}$, and $R_{21}$, which may be identical or different, designate an alkyl or a hydroxyalkyl radical comprising about 1 to 4 carbon atoms, r and s are integers lying in the range about 2 to 20, and X— is an anion derived from an inorganic or an organic acid.

One particularly preferred compound of formula (VIII) is the one for which each of $R_{18}$, $R_{19}$, $R_{20}$, and $R_{21}$ represents a methyl radical and r=3, s=6 and X=Cl, which is known as hexadimethrine chloride according to the INCI (CTFA) nomenclature.

(8) polyquaternary ammonium polymers comprising motifs of formula (IX):

(IX)

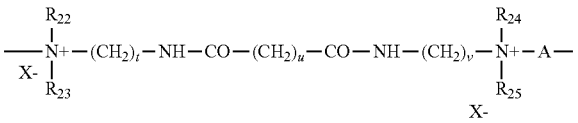

in which:

$R_{22}$, $R_{22}$, $R_{24}$, and $R_{25}$, which may be identical or different, represent a hydrogen atom or a methyl, ethyl, propyl, β-hydroxyethyl, β-hydroxypropyl, or —CH2CH2(OCH2CH2)pOH radical;

where p is equal to 0 or to an integer lying in the range 1 to 6, with the proviso that $R_{22}$, $R_{23}$, $R_{24}$, and $R_{25}$ do not simultaneously represent a hydrogen atom;

t and u, which may be identical or different, are each an integer lying in the range 1 to 6;

v is equal to 0 or to an integer lying in the range 1 to 34;

X— is an anion such as a halide;

A designates a dihalide or preferably represents —CH2-CH2-O—CH2-CH2-.

Such compounds are described, for example, in patent application EP-A-122 324.

Among these polymers, mention may be made, for example, of "Mirapol® A 15", "Mirapol® AD1", "Mirapol® AZ1", and "Mirapol® 175" sold by the supplier Miranol.

(9) Quaternary polymers of vinylpyrrolidone and of vinylimidazole, such as the products sold under the names Luviquat® FC 905, FC 550, and FC 370 by the supplier BASF.

(10) Cationic polysaccharides in particular celluloses and cationic galactomannan gums.

Among cationic polysaccharides, mention may be made more particularly of cellulose ether derivatives including quaternary ammonium groups, cationic cellulose copolymers, or cellulose derivatives grafted with a quaternary ammonium water-soluble monomer, and cationic galactomannan gums.

The cellulose ether derivatives comprising quaternary ammonium groups described in French patent 1 492 597. These polymers are also defined in the CTFA dictionary as hydroxyethyl cellulose quaternary ammoniums which have reacted with an epoxide substituted by a trimethyl-ammonium group.

Cationic cellulose copolymers derivatives or cellulose derivatives grafted with a quaternary ammonium water-soluble monomer are described in particular in U.S. Pat. No. 4,131,576, such as hydroxyalkyl celluloses like hydroxymethyl, hydroxyethyl, or hydroxypropyl celluloses grafted in particular with a methacryloylethyl trimethylammonium, methacrylamido propyl trimethylammonium, or dimethyl diallylammonium salt.

Cationic galactomannan gums are described more particularly in U.S. Pat. Nos. 3,589,578 and 4,031,307, in particular guar gums containing cationic trialkylammonium groups. Guar gums modified with a 2,3-epoxypropyltrimethylammonium salt (e.g. chloride) are used, for example.

Other cationic polymers, suitable for use in the context of the invention, are cationic proteins or cationic protein hydrolysates, polyalkyleneimines, in particular polyethyleneimines, polymers containing vinylpyridine motifs or vinylpyridinium motifs, condensates of polyamines and of epichlorohydrin, quaternary polyureylenes, and chitin derivatives.

The cationic proteins or protein hydrolysates may in particular be chemically modified polypeptides carrying quaternary ammonium groups at the end of the chain or grafted thereto. Their molecular mass may, for example, lie in the range 1500 to 10,000 and in particular, for example, in the range 2000 to 5000.

Preferably, these polypeptides are of vegetable origin.

In particular, mention may be made of:

hydrolysates of proteins of wheat, soya, or rice modified by cocodimonium hydroxypropyl groups;

hydrolysates of proteins of wheat, soya, jojoba, oats, or rice modified by trimonium groups;

hydrolysates of proteins of wheat, soya, or jojoba modified by laurdimonium hydroxypropyl groups; and hydrolysates of proteins of jojoba, soya, or rice modified by steardimonium hydroxypropyl groups.

Among these products mention may be made for example of the products sold by the supplier Cognis under the name GLUADIN WQ, and by the supplier CRODA under the names Hydrotriticum WQ PE or Croquat Soya.

Among all of the cationic polymers suitable for use in the context of the present invention, it is preferred to implement cationic cyclopolymers, such as the dimethyldiallylammonium chloride homopolymers or copolymers sold under the names "Merquat 100", "Merquat 550" and "Merquat S" by the supplier Nalco, quaternary polymers of vinylpyrrolidone and of vinylimidazole, cationic polysaccharides, and mixtures thereof.

The conditioning agent(s) suitable for use in the invention, may be chosen from cationic surfactants.

The term "cationic surfactant" means a positively charged surfactant when it is contained in the composition of the invention. The surfactant may carry one or more permanent positive charges or it may contain one or more cationizable functions within the composition of the invention.

The cationic surfactant(s) suitable for use as conditioning agents of the present invention are preferably chosen from primary, secondary, or tertiary fatty amines, possibly polyoxyalkylenated, or salts thereof, quarternary ammonium salts, and mixtures thereof.

Fatty amines generally comprise at least one $C_8$-$C_{30}$ hydrocarbon chain. Among fatty amines suitable for use in the invention, mention may be made for example of stearyl amidopropyl dimethylamine and distearylamine.

Concerning quaternary ammonium salts, mention may be made for example of:

those that exhibit the following general formula (XII):

(XII)

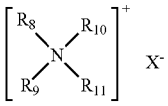

in which the $R_8$ to $R_{11}$ radicals, which may be identical or different, represent a linear or branched aliphatic radical comprising 1 to 30 carbon atoms, or an aromatic radical, such as aryl or alkylaryl, at least one of the $R_8$ to $R_{11}$ radicals denoting a radical comprising 8 to 30 carbon atoms, preferably 12 to 24 carbon atoms. The aliphatic radicals may include heteroatoms, such as, in particular, oxygen, nitrogen, sulfur, and halogens. The aliphatic radicals are, for example, chosen from $C_1$-$C_{30}$ alkyl, $C_1$-$C_{30}$ alkoxy, polyoxy($C_2$-$C_6$) alkylene, $C_1$-$C_{30}$ alkylamide, ($C_{12}$-$C_{22}$)alkyl ($C_2$-$C_6$)amidoalkyl, ($C_{12}$-$C_{22}$)alkyl acetate, and $C_1$-$C_{30}$ hydroxyalkyl radicals; X— is an anion chosen from the group of the halides, phosphates, acetates, lactates, ($C_2$-$C_6$)alkyl sulfates, or alkyl- or alkylarylsulfonates.

Among the quaternary ammonium salts of formula (XII), preference is given firstly to tetraalkylammonium chlorides such as, for example, dialkyldimethylammonium chlorides or alkyltrimethylammonium chlorides, in which the alkyl radical contains about 12 to 22 carbon atoms, in particular behenyltrimethylammonium chloride, distearyldimethylammonium chloride, cetyltrimethylammonium chloride, or benzyldimethylstearylammonium chloride, or, secondly to palmitylamidopropyltrimethylammonium chloride or stearamidopropyldimethyl(myristyl acetate)ammonium chloride sold under the name Ceraphyl® 70 by the supplier Van Dyk.

imidazolinium quaternary ammonium salts, such as, for example, those of following formula (XIII):

(XIII)

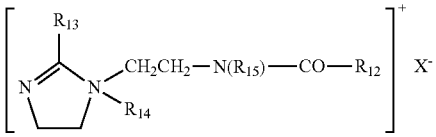

in which $R_{12}$ represents an alkenyl or alkyl radical comprising 8 to 30 carbon atoms, for example derived from tallow fatty acids; $R_{13}$ represents a hydrogen atom, a $C_1$-$C_4$ alkyl radical or an alkenyl or alkyl radical comprising 8 to 30 carbon atoms; $R_{14}$ represents a $C_1$-$C_4$ alkyl radical; $R_{15}$ represents a hydrogen atom or a $C_1$-$C_4$ alkyl radical; and X— is an anion chosen from the group of the halides, phosphates, acetates, lactates, alkyl sulfates, or alkyl- or alkylarylsulfonates. $R_{12}$ and $R_{13}$ preferably designate a mixture of alkenyl or alkyl radicals comprising 12 to 21 carbon atoms, for example derived from tallow fatty acids, $R_{14}$ preferably designates a methyl radical, and $R_{15}$ preferably designates hydrogen. Such a product is, for example, sold under the name "Rewoquat® W 75" by the supplier Rewo.

quaternary di or triammonium salts in particular of formula (XIV):

(XIV)

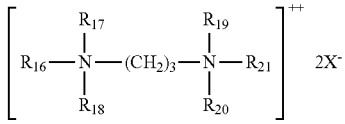

in which: $R_{16}$ denotes an alkyl radical comprising about 16 to 30 carbon atoms possibly hydroxylated and/or interrupted by one or more oxygen atoms; $R_{17}$ is chosen from hydrogen or an alkyl radical comprising 1 to 4 carbon atoms or a group ($R_{16a}$) ($R_{17a}$) ($R_{18a}$)N—$(CH_2)_3$—, $R_{16a}$, $R_{17a}$, $R_{18a}$, $R_{18}$, $R_{19}$, $R_{20}$, and $R_{21}$, which may be identical or different, are chosen from hydrogen or an alkyl radical comprising 1 to 4 carbon atoms; and X— is an anion chosen from the group comprising halides, acetates, phosphates, nitrates, and methylsufates. By way of example, such compounds are Finquat CT-P sold by the supplier Finetex (Quaternium 89) and Finquat CT sold by the supplier fine Quaternium 75);

quaternary ammonium salts comprising at least one ester function, such as those of formula (XV) below:

(XV)

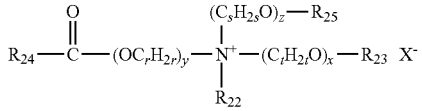

in which:

$R_{22}$ is chosen from $C_1$-$C_6$ alkyl radicals and $C_1$-$C_6$ hydroxyalkyl and dihydroxyalkyl radicals;

$R_{23}$ is chosen from:

the radical

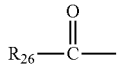

linear and branched, saturated and unsaturated $C_1$-$C_{22}$ hydrocarbon radicals $R_{27}$; and a hydrogen atom;

$R_{25}$ is chosen from:

the radical

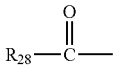

linear and branched, saturated and unsaturated $C_1$-$C_6$ hydrocarbon radicals $R_{29}$, and a hydrogen atom;

$R_{24}$, $R_{26}$, and $R_{28}$, which may be identical or different, are chosen from linear and branched, saturated and unsaturated $C_7$-$C_{21}$ hydrocarbon radicals;

r, s, and t, which may be identical or different, are each an integer lying in the range 2 to 6;

y is an integer lying in the range 1 to 10;

x and z, which may be identical or different, are each an integer lying in the range 0 to 10;

X— is an anion chosen from simple and complex, organic and inorganic anions;

with the proviso that the sum x+y+z lies in the range 1 to 15, that when x is 0, then $R_{23}$ is $R_{27}$ and that when z is 0, then $R_{25}$ is $R_{29}$.

The alkyl radicals $R_{22}$ may be linear or branched, and preferably linear.

Preferably, $R_{22}$ designates a methyl, ethyl, hydroxyethyl, or dihydroxypropyl radical, and preferably a methyl or ethyl radical.

Advantageously, the sum x+y+z lies in the range 1 to 10.

When $R_{23}$ is a hydrocarbon radical $R_{27}$, it may be long and have 12 to 22 carbon atoms, or short and have 1 to 3 carbon atoms.

When $R_{25}$ is a hydrocarbon radical $R_{29}$, it preferably has 1 to 3 carbon atoms.

Advantageously, $R_{24}$, $R_{26}$, and $R_{28}$, which may be identical or different, are chosen from linear and branched, saturated and unsaturated $C_{11}$-$C_{21}$ hydrocarbon radicals, and preferably from linear and branched, saturated and unsaturated $C_{11}$-$C_{21}$ alkyl and alkenyl radicals.

Preferably, x and z, which may be identical or different, are each equal to 0 or 1.

Advantageously, y is equal to 1.

Preferably, r, s, and t, which may be identical or different, are each equal to 2 or 3, and more particularly are equal to 2;

The anion X— is preferably a halide (chloride, bromide, or iodide) or an alkylsulfate, preferably methylsulfate. However, it is possible to use methanesulfonate, phosphate, nitrate, tosylate, an anion derived from organic acid such as acetate or lactate, or any other anion that is compatible with ammonium having an ester function.

The anion X— is more preferably chloride or methylsulfate.

In the composition of the invention, use is made more particularly of ammonium salts of formula (XV), in which:

$R_{22}$ designates a methyl or ethyl radical;

x and y are equal to 1;

z is equal to 0 or 1;

r, s, and t are equal to 2;

$R_{23}$ is chosen from:

the radical

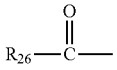

methyl, ethyl, and $C_{14}$-$C_{22}$ hydrocarbon radicals; and a hydrogen atom;

$R_{25}$ is chosen from:

the radical

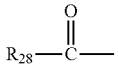

a hydrogen atom;

$R_{24}$, $R_{26}$, and $R_{28}$, which may be identical or different, are chosen from linear and branched, saturated and unsaturated $C_{13}$-$C_{17}$ hydrocarbon radicals, and preferably from linear and branched, saturated and unsaturated $C_{13}$-$C_{17}$ alkyl and alkenyl radicals;

Advantageously, the hydrocarbon radicals are linear.

By way of example, mention may be made of compounds of formula (XV) such as the salts (chloride or methyl sulfate salts in particular) of diacyloxyethyldimethylammonium, diacyloxyethylhydroxyethylmethylammonium, monoacyloxyethyldihydroxy-ethylmethylammonium, triacyloxyethylmethylammonium, monoacyloxyethylhydroxyethyldimethylammonium, and mixtures thereof. The acyl groups preferably have 14 to 18 carbon atoms and are obtained more particularly from a vegetable oil such as palm oil or sunflower oil. When the compound contains several acyl radicals, said radicals may be identical or different.

These compositions are obtained, for example, by direct esterification of optionally oxyalkylenated triethanolamine, triisopropanolamine, alkyldiethanolamine, or alkyldiisopropanolamine, with $C_{10}$-$C_{30}$ fatty acids or with mixtures of $C_{10}$-$C_{30}$ fatty acids of plant or animal origin or by transesterification of their methyl esters. This esterification is followed by quaternization using an alkylating agent such as an alkyl (preferably methyl or ethyl) halide, a dialkyl (preferably methyl or ethyl) sulfate, methyl methanesulfonate, methyl para-toluenesulfonate, glycol chlorohydrin or glycerol chlorohydrin.

Such compounds are sold, for example, under the names Dehyquart® by the supplier HENKEL Cognis, Stepanquat® by the supplier Stepan, Noxamium® by the supplier Ceca, and Rewoquat® WE 18 by the supplier Rewo-Witco.

The composition of the invention may preferably contain a mixture of quaternary ammonium mono-, di-, and tri-ester salts with a majority, by weight, of diester salts.

By way of example, for the mixture of ammonium salts, it is possible to use the mixture containing 15% to 30% by weight of acyloxyethyl-dihydroxyethyl-methylammonium methyl sulfate, 45% to 60% of diacyloxyethyl-hydroxyethyl-methylammonium methyl sulfate, and 15 to 30% of triacyloxyethyl-methylammonium methyl sulfate, the acyl radicals having 14 to 18 carbon atoms and being obtained from palm oil that is optionally partially hydrogenated.

The ammonium salts containing at least one ester function that are disclosed in U.S. Pat. Nos. 4,874,554 and 4,137,180 may also be used.

The cationic surfactant(s) particularly preferred for use in the invention are chosen from compounds of formula (XII) and of formula (XV).

Among all of the cationic surfactants that may be present in the composition of the invention, it is preferable to choose the salts of cetyl trimethyl ammonium, behenyl trimethyl ammonium, dipalmitoylethyl hydroxyethyl methyl ammonium, distearoylethyl hydroxyethyl methyl ammonium, methyl ($C_9$-$C_{19}$)alkyl ($C_{10}$-$C_{20}$)alkylamidoethylimidazolium, stearamidopropyldimethylamine, stearamidopropyl diméthylammonium salt, and mixtures thereof.

Among the silicones suitable for use as conditioning agents in accordance with the present invention, mention may be made, in a non-limiting manner, of:

I. Volatile Silicones:

These have a boiling point lying in the range 60° C. to 260° C. Among the silicones of this type mention may be made of:

(i) cyclic silicones of 3 to 7 and preferably 4 to 5 silicon atoms.

These are, for example, octamethylcyclo-tetrasiloxane sold under the name "Volatile Silicone 7207®" by the supplier Union Carbide, or "Silbione 70045 V2®" by the supplier Rhône-Poulenc, decamethylcyclopentasiloxane sold under the name "Volatile Silicone 7158®" by the supplier Union Carbide, and "Silbione 70045 V5®" by the supplier Rhône-Poulenc, and mixtures thereof. Mention is also made of cyclopolymers of the dimethylsiloxane/methylalkylsiloxane type, such as "Volatile Silicone FZ 3109®" sold by the supplier Union Carbide, which is a dimethylsiloxane/methyloctylsiloxane cyclocopolymer;

(ii) linear volatile silicones containing 2 to 9 silicon atoms and having a viscosity that is less than or equal to $5\times10^{-6}$ $m^2/s$ at 25° C.

An example is hexamethyldisiloxane sold under the name "Silbione 70041 V0.65®" by the supplier Rhône-Poulenc. This type of product is described in the article by Todd & Byers "Volatile silicone fluids for cosmetics", Cosmetics and Toiletries, Vol. 91, January 76, pages 27-32.

II. Non-Volatile Silicones:

These consist mainly of polyalkylsiloxanes, polyarylsiloxanes, polyalkylarylsiloxanes, organomodified polysiloxanes, as well as mixtures thereof. They may be in the form of oils, gums, and resins.

Concerning polyalkylsiloxanes, mention may be made mainly of linear polydimethylsiloxanes with a viscosity that is greater than $5\times10^{-6}$ $m^2/s$, and preferably less than 2.6 $m^2/s$, i.e.:

containing trimethylsilyl end groups, such as, for example, and in a non-limiting manner, the "Silbione®" oils of the series 70047 sold by the supplier Rhône-Poulenc, the oil "wacker Belsil DM 60000 from WACKER" or certain "Viscasil®"s from the supplier General Electric;

containing trihydroxysilyl end groups, such as the oils of the series "48 V®" from the supplier Rhône-Poulenc.

In this class of polyalkylsiloxanes, mention may also be made of the polyalkylsiloxanes sold by the supplier Goldschmidt under the names "Abilwax 9800®" and "Abilwax 9801®", which are poly($C_1$-$C_{20}$)alkylsiloxanes.

Among the polyalkylarylsiloxanes that may be mentioned are linear and/or branched polydimethylphenylsiloxanes and polydimethyldiphenylsiloxanes, with a viscosity lying in the range $10^{-5}$ to $5\times10^{-2}$ $m^2/s$, such as, for example:

the oil "Rhodorsil®" 763 from Rhône-Poulenc;

the "Silbione®" oils of the series 70641 from Rhône-Poulenc, such as the oils "Silbione 70641 V30®" and "Silbione 70641 V200®";

the product "DC 556®" cosmetic grade fluid from Dow Corning;

silicones of the PK series from Bayer, such as "PK20®";

silicones of the PN and PH series from Bayer, such as "PN 1000®" and "PH 1000®";

certain oils of the SF series from General Electric, such as "SF 1250®", "SF 1265®", "SF 1154®", and "SF 1023®".

The silicone gums in accordance with the present invention are polydiorganosiloxanes with a high number-average molecular mass lying in the range 200,000 to 1,000,000, that are used alone or as a mixture in a solvent chosen from volatile silicones, polydimethylsiloxane (PDMS) oils, polyphenylmethylsiloxane (PPMS) oils, isoparaffins, methylene chloride, pentane, dodecane, tridecane, and tetradecane, or mixtures thereof.

Mention is made, for example, of the compounds having the following structures:

poly[(dimethylsiloxane)/(methylvinylsiloxane)] gums;

poly[(dimethylsiloxane)/(diphenylsiloxane)] gums;

poly[(dihydrogen dimethylsiloxane)/(divinylsiloxane)] gums;

poly[(dimethylsiloxane)/(phenylmethylsiloxane] gums; and poly[(dimethylsiloxane)/(diphenylsiloxane)/(methylvinylsiloxane)] gums.

Mention may be made of the gum "Mirasil DM 300 000" from the supplier Rhodia.

Mention may be made, for example, in a non-limiting manner, of the following mixtures:

1) mixtures formed from a polydimethylsiloxane that is hydroxylated at the end of the chain (Dimethiconol according to the CTFA nomenclature) and of a cyclic polydimethylsiloxane (Cyclomethicone according to the CTFA nomenclature), such as the products "Q2 1401®" or "Dow Corning 1501 Fluid" sold by the supplier Dow Corning;

2) mixtures formed from a polydimethylsiloxane gum with a cyclic silicone, such as the product "SF 1214 Silicone Fluid®" from General Electric, which is an "SE 30®" gum of MW 500,000 (—Mn) dissolved in "SF 1202 Silicone Fluid®" (decamethylcyclopentasiloxane);

3) mixtures of two PDMS of different viscosities, in particular of a PDMS gum and of a PDMS oil, such as the products "SF 1236®" and "CF 1241®" from the supplier General Electric. The product "SF 1236®" is the mixture of an "SE 30®" gum defined above with a viscosity of 20 $m^2/s$ and of an "SF 96®" oil with a viscosity of 5.106 $m^2/s$ (15% "SE 30®" gum and 85% "SF 96®" oil).

The product "CF 1241®" is the mixture of an "SE 30®" gum (33%) and of a PDMS (67%) with a viscosity of $10^{-3}$ $m^2/s$.

The polyorganosiloxane resins suitable for use in accordance with the invention are crosslinked siloxane systems containing the units: $R_2SiO_2/2$, $RSiO_3/2$, and $SiO_4/2$ in which R represents a hydrocarbon group containing 1 to 6 carbon atoms or a phenyl group. Among these products, those particularly preferred are the ones in which R denotes a lower alkyl radical or a phenyl radical.

Among these resins, mention may be made of the product sold under the name "Dow Corning 593®" or those sold under the names "Silicone Fluid SS 4230" and "Silicone Fluid SS 4267" by the supplier General Electric and which are dimethyl/trimethylpolysiloxanes.

The organomodified silicones in accordance with the present invention are silicones as defined above, whose general structure comprises one or more organofunctional groups directly attached to the siloxane chain or attached via a hydrocarbon radical.

Mention is made, for example, of silicones comprising:

a) perfluoro groups such as trifluoroalkyl groups, such as, for example, those sold by the supplier General Electric under the name "FF.150 Fluorosilicone Fluid®" or by the supplier Shin-Etsu under the names "X-22-819®", "X-22-82®", "X-22-821®", and "X-22-822®";

b) hydroxyacylamino groups such as, for example, those described in patent application EP-A-0 342 834 and in particular the silicone sold by the supplier Dow Corning under the name "Q2-8413®";

c) thiol groups such as the silicones "X 2-8360®" from the supplier Dow Corning or "GP 72A®" and "GP 71®" from Genesee;

d) non-quaternized amine groups, such as in "GP 4 Silicone Fluid®" from Genesee, "GP 7100®" from Genesee, "Q2 8220®" from Dow Corning, "AFL 40®" from Union Carbide, or the silicone known as "Amodimethicone" in the CTFA dictionary;

e) carboxylate groups, such as the products described in patent EP 186 507 from Chisso Corporation;

f) hydroxylated groups, such as the polyorganosiloxanes containing a $C_2$-$C_{18}$ hydroxyalkyl function, which groups are described in patent application FR 85/16334, for example.

Mention may be made most particularly of the product sold by Dow Corning under the name DC 190;

g) alkoxylated groups, such as in the silicone copolymer "F 755®" from SWS Silicones and the products "Abilwax 2428®", "Abilwax 2434®", and "Abilwax 2440®" from the supplier Goldschmidt;

h) ($C_8$-$C_{22}$)acyloxy($C_2$-$C_{18}$)alkyl groups such as, for example, the polyorganopolysiloxanes described in patent application FR 88/17433;

i) quaternary ammonium groups, such as in the products "X2 81 08" and "X2 81 09®" and the product "ABIL K 3270®" from the supplier Goldschmidt;

j) amphoteric or betaine groups, such as in the product sold by the supplier Goldschmidt under the name "Abil B 9950®";

k) bisulfite groups, such as in the products sold by the supplier Goldschmidt under the names "Abil S 201®" and "Abil S 255®";

l) polyethyleneoxy and/or polypropyleneoxy groups optionally including $C_6$-$C_{24}$ alkyl groups such as the products known as dimethicone copolyol sold by the supplier Dow Corning under the name DC 1248 or the oils Silwet L 722, L 7500, L 77, L 711 from the supplier Union Carbide and ($C_{12}$) alkyl methicone copolyol sold by the supplier Dow Corning under the name Q2 5200.

According to the invention, it is also possible to use silicones comprising a polysiloxane portion and a portion consisting of a nonsilicone organic chain, one of the two portions constituting the main chain of the polymer, the other being grafted onto said main chain. These polymers are described, for example, in patent applications EP-A-0 412 704, EP-A-0 412 707, EP-A-0 640 105, WO 95/00578, EP-A-0 582 152, and WO 93/23009, and U.S. Pat. Nos. 4,693,935, 4,728,571, and 4,972,037. These polymers are preferably anionic or nonionic.

Such polymers are, for example, copolymers that can be obtained by radical polymerization from the monomer mixture consisting of:

a) 50% to 90% by weight of tert-butyl acrylate;

b) 0 to 40% by weight of acrylic acid;

c) 5% to 40% by weight of silicone macromer of formula:

(XVIII)

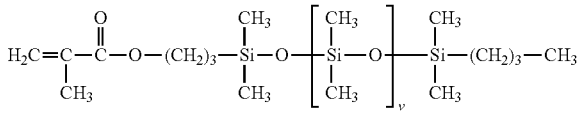

with v being a number lying in the range 5 to 700; the weight percentages being calculated relative to the total weight of the monomers.

Other examples of grafted silicone polymers are, in particular, polydimethylsiloxanes (PDMS) onto which there are grafted, via a thiopropylene-type connecting chain, mixed polymer motifs of the poly(meth)acrylic acid type and of the polyalkyl(meth)acrylate type and polydimethylsiloxanes (PDMS) onto which are grafted, via a thiopropylene-type connecting chain, polymer motifs of the polyisobutyl(meth) acrylate type.

In the invention, all of the silicones may also be used in the form of emulsions, nanoemulsions, or microemulsions.

The polyorganosiloxanes more particularly preferred in accordance with the invention are:

non-volatile silicones chosen from the family of polyalkylsiloxanes containing trimethylsilyl end groups such as oils with a viscosity lying in the range 0.2 $m^2/s$ to 2.5 $m^2/s$ at 25° C. such as oils of the series DC200 from Dow Corning, in particular the oil having a viscosity of 60,000 Cst, oils of the series Silbione 70047, and preferably the oil 70 047 V 500 000 sold by the supplier Rhodia Chimie, polyalkylsiloxanes containing dimethylsilanol end groups such as dimethiconol, or polyalkylarylsiloxanes such as the oil Silbione 70641 V 200 sold by the supplier Rhodia Chimie;

polysiloxanes containing amine groups such as amodimethicones or trimethylsilylamodimethicone.

The viscosities of the silicones may be determined in particular by ASTM standard D445-97 (viscometry).

When the conditioning agent in the composition according to the invention is a hydrocarbon, it is a linear or branched $C_8$-$C_{300}$ hydrocarbon.

Among the hydrocarbons that are liquid at room temperature, corresponding to this definition, mention may be made in particular of isododecane, isohexadecane and its isomers (such as 2,2,4,4,6,6-heptamethylnonane), isoeicosane, isotetracosane and isomers of said compounds, n-dodecane, n-nonane, n-undecane, n-tridecane, n-pentadecane and mixtures of these hydrocarbons.

Isododecane or an isomer thereof is preferably used in the invention.

When the conditioning agent is a fatty alcohol, it is of the $C_8$-$C_{30}$ linear or branched, saturated or unsaturated type. Among these fatty alcohols, mention may for example be made of 2-butyloctanol, lauryl alcohol, oleyl alcohol, isocetyl alcohol, isostearyl alcohol, behenyl alcohol, stearyl alcohol, cetylic alcohol, and mixtures thereof.

When the conditioning agent is a fatty ester, it may be either an ester of a $C_8$-$C_{30}$ fatty acid and of a $C_1$-$C_{30}$ alcohol including esters of a $C_8$-$C_{30}$ fatty acid and of a $C_8$-$C_{30}$ alcohol or an ester of a $C_1$-$C_7$ acid or diacid and of a $C_8$-$C_{30}$ fatty alcohol.

Among these esters, mention may be made for example of: ethyl, isopropyl, 2-ethylhexyl, and 2-octyldecyl palmitate; isopropyl, butyl, cetyl, and 2-octyldecyl myristate; butyl and hexyl stearate; hexyl and 2-hexyldecyl laurate; isononyl isononanoate; dioctyl malate; dioctyl; myristyl and stearyl myristate; cetyl palmitate; myristyl, stearyl, and cetyl stéarate; and mixtures thereof.

The ceramides or their analogs, such as the glycoceramides, suitable for use as conditioning agents in the compositions of the invention, are known per se and are natural or synthetic molecules that may correspond to the following general formula (XIX):

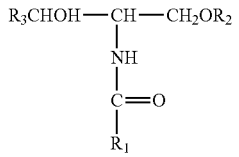

(XIX)

in which:

$R_1$ denotes a linear or branched, saturated or unsaturated alkyl radical derived from $C_{14}$-$C_{30}$ fatty acids, it being possible for this radical to be substituted with a hydroxyl group in the alpha position, or a hydroxyl group in the omega position esterified with a saturated or unsaturated $C_{16}$-$C_{30}$ fatty acid;

$R_2$ denotes a hydrogen atom or a (glycosyl)n, (galactosyl)m, or sulfogalactosyl radical, in which n is an integer lying in the range 1 to 4 and m is an integer lying in the range 1 to 8;

$R_3$ denotes a saturated or unsaturated $C_{15}$-$C_{26}$ hydrocarbon radical in the alpha position, it being possible for this radical to be substituted with one or more $C_1$-$C_{14}$ alkyl radicals;

it being understood that, in the case of the natural ceramides or glycoceramides, $R_3$ can also denote a $C_{15}$-$C_{26}$ alpha-hydroxyalkyl radical, the hydroxyl group optionally being esterified with a $C_{16}$-$C_{30}$ alpha-hydroxy acid.

In the context of the present invention, the preferred ceramides are those described by Downing in Arch. Dermatol., Vol. 123, 1381-1384, 1987, or those described in French patent FR 2673179.

The ceramides more particularly preferred according to the invention are the compounds for which $R_1$ denotes a saturated or unsaturated alkyl derived from $C_{16}$-$C_{22}$ fatty acids; $R_2$ denotes a hydrogen atom; and $R_3$ denotes a saturated linear $C_{15}$ radical.

Such compounds are, for example:

N-linoleoyldihydrosphingosine;

N-oleoyldihydrosphingosine;

N-palmitoyldihydrosphingosine;

N-stearoyldihydrosphingosine;

N-behenoyldihydrosphingosine;

or mixtures of these compounds.

Even more preferably, use is made of the ceramides for which $R_1$ denotes a saturated or unsaturated alkyl radical derived from fatty acids, $R_2$ denotes a galactosyl or sulfogalactosyl radical, and $R_3$ denotes a —CH—CH—(CH2)12-CH3 group.

By way of example, mention may be made of the product consisting of a mixture of these compounds, sold under the trade name Glycocer by the supplier Waitaki International Biosciences.

Anionic, Nonionic, Amphoteric, and Zwitterionic Surfactants

Compositions for washing the hair include one or more surfactants chosen from anionic, nonionic, amphoteric, and zwitterionic surfactants.

These surfactants are mentioned in particular in CTFA (Edition 2004) under the term "surfactant-cleansing agent".

The term "anionic surfactant", means a surfactant including only anionic groups by way of ionic or ionizable groups. These anionic groups are preferably chosen from the groups CO2H, CO2-, SO3H, SO3-, OSO3H, OSO3-, O2PO2H, O2PO2H—, O2PO22-.

By way of examples of anionic surfactants (ii) suitable for use in the composition of the invention, mention may be made of alkyl sulfates, alkyl ether sulfates, alkylamido ether sulfates, alkylaryl polyether sulfates, monoglyceride sulfates, alkylsulfonates, alkylamidesulfonates, alkylarylsulfonates, alpha-olefinsulfonates, paraffinsulfonates, alkyl sulfosuccinates, alkyl ether sulfosuccinates, alkylamidesulfosuccinates, alkyl sulfoacetates, acylsarcosinates, acylgiutamates, alkyl sulfosuccinamates, acylisethionates, and N-acyltaurates, alkyl monoester salts and salts of polyglycoside-polycarboxylic acid, acyllactylates, salts of D-galactoside-uronic acids, salts of alkyl ether-carboxylic acids, salts of alkyl aryl ether-carboxylic acids, salts of alkyl amidoether-carboxylic acids, and the corresponding non-salt forms of all of these compounds, the alkyl and acyl groups of all these compounds comprising 6 to 24 carbon atoms and the aryl group designating a phenyl group.

The compounds may be oxyethylene and thus preferably comprise 1 to 50 ethylene oxide motifs.

The salts of $C_6$-$C_{24}$ alkyl monoesters and of polyglycoside-polycarboxylic acids may be chosen from $C_6$-$C_{24}$ alkyl polyglycoside citrates, $C_6$-$C_{24}$ alkyl polyglycoside tartrates, and $C_6$-$C_{24}$ alkyl polyglycoside-sulfosuccinates.

When the anionic surfactant(s) (ii) is/are in salt form, it/they may be chosen from the alkali-metal salts such as the sodium or potassium salt, and preferably the sodium salt, the ammonium salts, the amine salts and in particular the aminoalcohol salts, or the alkaline-earth-metal salts, such as magnesium salt.

By way of examples of aminoalcohols, mention may be made for example of: mono-, di-, and tri-ethanolamine salts; mono-, di-, and tri-isopropanol-amine salts; and 2-amino 2-methyl 1-propanol, 2-amino 2-methyl 1,3-propanediol, and tris(hydroxymethyl)amino methane salts.

Alkali or alkaline-earth metals are preferably used, and in particular sodium or magnesium salts.

Among all of the anionic surfactants (ii) mentioned, ($C_6$-$C_{24}$) alkyl sulfates, ($C_6$-$C_{24}$) alkyl ether sulfates comprising 2 to 50 ethylene oxide motifs, in particular in the form of alkali-metal, ammonium, aminoalcohol, and alkaline-earth-metal salts, or a mixture of these compounds are preferably used.

For example, it is preferred to ($C_{12}$-$C_{20}$)alkyl sulfates, ($C_{12}$-$C_{20}$)alkyl ether sulfates comprising 2 to 50 ethylene oxide motifs, in particular in the form of salts of alkali metals, ammonium, aminoalcohol, and alkaline-earth metals. Better still, use may preferably be made of sodium lauryl ether sulfate containing 2.2 mol of ethylene oxide.

Examples of nonionic surfactants suitable for use in the cosmetic composition used in the invention are described, for example, in "Handbook of Surfactants" by M. R. Porter, published by Blackie & Son (Glasgow and London), 1991, pp 116-178. They are chosen for example from alcohols, alpha-diols and ($C_1$-$C_{20}$) alkyl phenols or polyethoxylated, polypropoxylated, or polyglycerolated fatty acids, having fatty chains comprising, for example, 8 to 18 carbon atoms, it being possible for the number of ethylene oxide or propylene oxide groups to lie in the range 2 to 50 for example, and it being possible for the number of glycerol groups to lie in the range 2 to 30 for example.

Mention may also be made of copolymers of ethylene and propylene oxide, optionally-oxyethylenated sorbitan fatty acid esters, sucrose fatty acid esters, polyoxyalkylenated fatty acid esters, optionally-oxyalkylenated alkylpolyglycosides, alkylglucoside esters, N-alkylglucamine and N-acylmethylglucamine derivatives, aldobionamides, and amine oxides.

The amphoteric or zwitterionic surfactant(s) suitable for use in the present invention may for example be derivatives of secondary or tertiary or possibly quarternized aliphatic amines including at least one anionic group, such as, for example, a carboxylate, sulfonate, sulfate, phosphate, or phosphonate group, and in which the aliphatic group or at least one of the aliphatic groups may be a linear or branched chain comprising 8 to 22 carbon atoms.

Mention may, for example, be made of ($C_8$-$C_{20}$)alkyl betaines, sulfobetaines, $C_8$-$C_{20}$ alkyl amido($C_3$-$C_8$ alkyl) betaines, or $C_8$-$C_{20}$ alkyl amido ($C_6$-$C_8$ alkyl)sulfobetaines. Preferably, the betainic amphoteric or zwitterionic surfactant(s) (iii) is/are chosen from ($C_8$-$C_{20}$)alkyl betaines and C8-20 alkyl amido($C_3$-$C_8$ alkyl)betaines.

Among the derivatives of secondary or tertiary or possibly quarternized aliphatic amines that are suitable for use, as defined above, mention may also be made of compositions with the following respective structures (A2) and (A3):

$$Ra—CONHCH_2CH_2—N+(Rb)(Rc)(CH_2COO—) \quad (A2)$$

in which:

Ra represents a $C_{10}$-$C_{30}$ alkyl or alkenyl group derived from an Ra—COOH acid that is preferably present in hydrolyzed coconut oil or a heptyl, nonyl, or undecyl group;

Rb represents a beta-hydroxyethyl group; and

Rc represents a carboxymethyl group; and $$Ra'—CONHCH_2CH_2—N(B)(B') \quad (A3)$$

in which:

B represents —CH2CH2OX';

B' represents —($CH_2$)z-Y', with z=1 or 2;

X' represents the group —CH2-COOH, CH2-COOZ', —CH2CH2-COOH, —CH2CH2-COOZ' or a hydrogen atom;

Y' represents —COOH, —COOZ', the group —CH2-CHOH—SO3H or —CH2-CHOH—SO3Z'

Z' represents an ion derived from an alkali or an alkaline-earth metal, such as sodium, an ammonium ion, or an ion derived from an organic amine.

Ra' represents a $C_{10}$-$C_{30}$ alkyl or alkenyl group of an acid Ra'—COOH that is preferably present in hydrolyzed linseed oil or coconut oil, an alkyl group, such as a $C_{17}$ alkyl group and its iso form, or an unsaturated $C_{17}$ group.

Compounds corresponding to the formula (A3) are preferred. These compounds are also classified in the CTFA dictionary, 5th edition, 1993, under the names disodium cocoamphodiacetate, disodium lauroamphodiacetate, disodium caprylamphodiacetate, disodium capryloamphodiacetate, disodium cocoamphodipropionate, disodium lauroamphodipropionate, disodium caprylamphodipropionate, disodium capryloamphodipropionate, lauroamphodipropionic acid, and cocoamphodipropionic acid.

By way of example, mention may be made of the cocoamphodiacetate sold by the supplier Rhodia under the name MIRANOL® C2M concentrate.

Among all of the above-mentioned amphoteric or zwitterionic surfactants (iii), use is preferably made of $C_8$-$C_{20}$ alkyl betaines, $C_8$-$C_{20}$ alkyl amido ($C_3$-$C_8$ alkyl)betaines and mixtures thereof. More preferably, the amphoteric or zwitterionic surfactant(s) is/are chosen from cocoylamidopropylbetaine and cocoylbetaine.

Fixing Polymers

In order to shape the hair temporarily, the composition for spraying may contain one or more fixing polymers, preferably selected from anionic, amphoteric, and nonionic fixing polymers.

In the meaning of the present invention, the term "fixing polymer" means a polymer that is capable of fixing and/or holding the shape of the hair style.

Fixing polymers may be used in dissolved form, or in the form of dispersed solid polymer particles.

The anionic, amphoteric, and nonionic fixing polymers that are suitable for use in accordance with the invention are described below.

The anionic fixing polymers generally used are polymers comprising groups derived from carboxylic acid, sulfonic acid, or phosphoric acid and have a molecular weight lying in the range approximately 500 to 5,000,000.

1) The carboxylic groups are provided by unsaturated monocarboxylic or dicarboxylic acid monomers such as those corresponding to the formula:

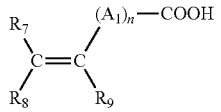

(XX)

in which n is an integer from 0 to 10, $A_1$ denotes a methylene group, optionally connected to the carbon atom of the unsaturated group, or to the neighboring methylene group when n is greater than 1, via a hetero atom such as oxygen or sulfur, $R_7$ denotes a hydrogen atom or a phenyl or benzyl group, $R_8$ denotes a hydrogen atom or a lower alkyl or carboxyl group, $R_9$ denotes a hydrogen atom, a lower alkyl group or a —CH2-COOH, phenyl, or benzyl group.

In the above-mentioned formula, a lower alkyl radical preferably denotes a group having 1 to 4 carbon atoms and in particular methyl and ethyl.

The anionic fixing polymers containing carboxylic groups that are preferred according to the invention are:

A) Acrylic or methacrylic acid homo- or co-polymers, or salts thereof and in particular the products sold under the names Versicol E or K by the supplier Allied Colloid and Ultrahold by the supplier BASF. Copolymers of acrylic acid and of acrylamide sold in the form of their sodium salt under the names Reten 421, 423, or 425 by the supplier Hercules, the sodium salts of polyhydroxycarboxylic acids.

B) Copolymers of acrylic or methacrylic acids with a monoethylenic monomer such as ethylene, styrene, vinyl esters, acrylic or methacrylic acid esters, optionally grafted onto a polyalkylene glycol such as polyethylene glycol and optionally crosslinked. Such polymers are described in particular in French patent 1 222 944 and German patent application 2 330 956, the copolymers of this type comprising an optionally N-alkylated and/or -hydroxyalkylated acrylamide motif in their chain as described in particular in Luxembourg patent applications 75370 and 75371 or sold under the name Quadramer by the supplier American Cyanamid. Mention may also be made of copolymers of acrylic acid and of $C_1$-$C_4$ alkyl methacrylate and terpolymers of vinylpyrrolidone, of acrylic acid, and of $C_1$-$C_{20}$ alkyl methacrylate, for example of lauryl methacrylate, such as that sold by the supplier ISP under the name Acrylidone LM, and methacrylic acid/ethyl acrylate/tert-butyl acrylate terpolymers such as the product sold under the name Luvimer 100 P by the supplier BASF.

C) Copolymers derived from crotonic acid such as those comprising vinyl acetate or propionate motifs in their chain and optionally other monomers such as allyl esters or methallyl esters, vinyl ether or vinyl ester of a linear or branched saturated carboxylic acid with a long hydrocarbon chain such as those containing at least 5 carbon atoms, it being possible for these polymers optionally to be grafted and crosslinked, or alternatively a vinyl, allyl or methallyl ester of an α- or β-cyclic carboxylic acid. Such polymers are described, inter alia, in French patents 1 222 944, 1 580 545, 2 265 782, 2 265 781, 1 564 110, and 2 439 798. Commercial products falling within this class are the resins 28-29-30, 26-13-14, and 28-13-10 sold by the supplier National Starch.

D) copolymers derived from $C_4$-$C_8$ monounsaturated carboxylic acids or anhydrides chosen from:

copolymers comprising (i) one or more maleic, fumaric or itaconic acids or anhydrides and (ii) at least one monomer chosen from vinyl esters, vinyl ethers, vinyl halides, phenylvinyl derivatives, acrylic acid and its esters, the anhydride functions of these copolymers optionally being monoesterified or monoamidated. Such polymers are described in particular in U.S. Pat. Nos. 2,047,398, 2,723,248, and 2,102,113, and patent GB 839 805, and in particular those sold under the names Gantrez AN or ES by the supplier ISP;

copolymers comprising (i) one or more maleic, citraconic, or itaconic anhydrides, and (ii) one or more monomers chosen from allyl or methallyl esters optionally comprising one or more acrylamide, methacrylamide, α-olefin, acrylic or methacrylic esters, acrylic or methacrylic acid, or vinylpyrrolidone groups in their chain;

the anhydride functions of these copolymers optionally being monoesterified or monoamidated.

These polymers are described, for example, in French patents 2 350 384 and 2 357 241 by the Applicant.

E) polyacrylamides comprising carboxylate groups.

The polymers comprising sulfonic groups are polymers comprising vinylsulfonic, styrenesulfonic, naphthalenesulfonic, or acrylamidoalkylsulfonic motifs.

These polymers can be chosen in particular from:

polyvinylsulfonic acid salts having a molecular weight lying in the range approximately 1000 and 100,000, as well as the copolymers with an unsaturated comonomer such as acrylic or methacrylic acids and their esters, as well as acrylamide or its derivatives, vinyl ethers and vinylpyrrolidone;

polystyrenesulfonic acid salts, sodium salts having a molecular weight of about 500,000 and about 100,000, which are sold respectively under the names Flexan 500 and Flexan 130 by National Starch. These compounds are disclosed in patent FR 2 198 719.

polyacrylamidesulfonic acid salts, those mentioned in U.S. Pat. No. 4,128,631, and more particularly polyacrylamidoethylpropanesulfonic acid sold under the name Cosmedia Polymer HSP 1180 by Henkel.

According to the invention, the anionic fixing polymers are preferably chosen from acrylic acid copolymers, such as the acrylic acid/ethyl acrylate/N-tert-butylacrylamide terpolymer sold under the name Ultrahold Strong by the supplier BASF, copolymers derived from crotonic acid, such as vinyl acetate/vinyl tert-butylbenzoate/crotonic acid terpolymers and the crotonic acid/vinyl acetate/vinyl neododecanoate terpolymers sold under the name Resin 28-29-30 by the supplier National Starch, polymers derived from maleic, fumaric, or itaconic acids or anhydrides with vinyl esters, vinyl ethers, vinyl halides, phenylvinyl derivatives, and acrylic acid and esters thereof, such as the methyl vinyl ether/monoesterified maleic anhydride copolymer sold under the name Gantrez ES 425 by the supplier ISP, the copolymers of methacrylic acid and of methyl methacrylate sold under the name Eudragit L by the supplier Rohm Pharma, the copolymer of methacrylic acid and of ethyl acrylate sold under the name Luvimer MAEX or MAE by the supplier BASF, the vinyl acetate/crotonic acid copolymer sold under the name Luviset CA 66 by the supplier BASF, and the vinyl acetate/crotonic acid copolymer grafted with polyethylene glycol sold under the name Aristoflex A by the supplier BASF.

The anionic fixing polymers which are most particularly preferred are chosen from the methyl vinyl ether/monoesterified maleic anhydride copolymer sold under the name Gantrez ES 425 by the supplier ISP, the acrylic acid/ethyl acrylate/N-tert-butylacrylamide terpolymer sold under the name Ultrahold Strong by the supplier BASF, the copolymers of methacrylic acid and of methyl methacrylate sold under the name Eudragit L by the supplier Rohm Pharma, the vinyl acetate/vinyl tert-butylbenzoate/crotonic acid terpolymers, the crotonic acid/vinyl acetate/vinyl neododecanoate terpolymers sold under the name Resin 28-29-30 by the supplier National Starch, the copolymer of methacrylic acid and of ethyl acrylate sold under the name Luvimer MAEX or MAE by the supplier BASF, and the vinylpyrrolidone/acrylic acid/lauryl methacrylate terpolymer sold under the name Acrylidone LM by the supplier ISP.

The amphoteric fixing polymers that are suitable for use in accordance with the invention can be chosen from polymers comprising motifs B and C distributed randomly in the polymer chain, in which B denotes a motif derived from a monomer comprising at least one basic nitrogen atom, and C denotes a motif derived from an acid monomer comprising one or more carboxylic or sulfonic groups, or alternatively B and C can denote groups derived from carboxybetaine or sulfobetaine zwitterionic monomers;

B and C can also denote a cationic polymer chain comprising primary, secondary, tertiary or quaternary amine groups, in which at least one of the amine groups carries a carboxylic or sulfonic group connected via a hydrocarbon radical or alternatively B and C form part of a chain of a polymer containing an α,β-dicarboxylic ethylene motif in which one of the carboxylic groups has been made to react with a polyamine comprising one or more primary or secondary amine groups.

The amphoteric fixing polymers corresponding to the definition given above which are more particularly preferred are chosen from the following polymers:

(1) polymers resulting from the copolymerization of a monomer derived from a vinyl compound carrying a carboxylic group such as, more particularly, acrylic acid, methacrylic acid, maleic acid, α-chloroacrylic acid, and a basic monomer derived from a substituted vinyl compound containing at least one basic atom, such as, more particularly, dialkylaminoalkyl methacrylate and acrylate, dialkylaminoalkyl methacrylamides and -acrylamides. Such compounds are described in U.S. Pat. No. 3,836,537.

(2) polymers comprising motifs derived from:

a) at least one monomer chosen from acrylamides and methacrylamides substituted on the nitrogen with an alkyl radical;

b) at least one acid comonomer containing one or more reactive carboxylic groups; and c) at least one basic comonomer such as esters containing primary, secondary, tertiary, and quaternary amine substituents of acrylic and methacrylic acids and the product of quaternization of dimethylaminoethyl methacrylate with dimethyl or diethyl sulfate.

The N-substituted acrylamides or methacrylamides which are more particularly preferred according to the invention are groups in which the alkyl radicals contain 2 to 12 carbon atoms and more particularly N-ethylacrylamide, N-tert-butylacrylamide, N-tert-octylacrylamide, N-octylacrylamide, N-decylacrylamide, N-dodecylacrylamide and the corresponding methacrylamides.

The acidic comonomers are chosen more particularly from acrylic acid, methacrylic acid, crotonic acid, itaconic acid, maleic acid, fumaric acid, and alkyl monoesters, having 1 to 4 carbon atoms, or maleic or fumaric acids or anhydrides.

The preferred basic comonomers are aminoethyl, butylaminoethyl, N,N'-dimethylaminoethyl, and N-tert-butylaminoethyl methacrylates.

The copolymers whose CTFA (4th edition, 1991) name is octylacrylamide/acrylates/butylaminoethyl methacrylate copolymer, such as the products sold under the name Amphomer or Lovocryl 47 by the supplier National Starch, are particularly used.

(3) crosslinked and alkylated polyamino amides partially or totally derived from polyamino amides of general formula XXI:

(XXI)

in which:

$R_{10}$ represents a divalent radical derived from a saturated dicarboxylic acid, a mono- or di-carboxylic aliphatic acid containing an ethylenic double bond, an ester of a lower alkanol, having 1 to 6 carbon atoms, of these acids, or a radical derived from the addition of any one of said acids to a bis(primary) or bis(secondary)amine, and Z denotes a bis(primary), mono- or bis(secondary) polyalkylene-polyamine radical and preferably represents:

a) in proportions in the range 60 to 100 mol %, the radical XXII

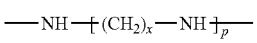

(XXII)

where x=2 and p=2 or 3, or alternatively x=3 and p=2 this radical being derived from diethylenetriamine, from triethylenetetraamine, or from dipropylenetriamine;

b) in proportions in the range 0 to 40 mol %, the radical (IV) above in which x=2 and p=1 and which is derived from ethylenediamine, or the radical derived from piperazine:

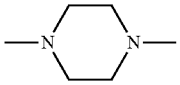

c) in proportions in the range 0 to 20 mol %, the —NH—(CH2)6-NH— radical derived from hexamethylenediamine, these polyamino amines being crosslinked by addition of a difunctional crosslinking agent chosen from epihalohydrins, diepoxides, dianhydrides, and bisunsaturated derivatives, using 0.025 mol to 0.35 mol of crosslinking agent per amine group of the polyamino amide and alkylated by the action of acrylic acid, chloroacetic acid, or an alkane sultone, or salts thereof.

The saturated carboxylic acids are preferably chosen from acids having 6 to 10 carbon atoms, such as adipic acid, 2,2,4-trimethyladipic acid, and 2,4,4-trimethyladipic acid, terephthalic acid, acids containing an ethylenic double bond such as, for example, acrylic acid, methacrylic acid, and itaconic acid.

The alkane sultones used in the alkylation are preferably propane sultone or butane sultone, the salts of the alkylating agents are preferably the sodium or potassium salts.

(4) polymers comprising zwitterionic motifs of formula XXIII:

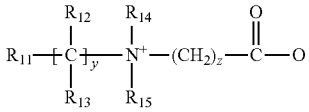

(XXIII)

in which:

$R_{11}$ denotes a polymerizable unsaturated group such as an acrylate, methacrylate, acrylamide, or methacrylamide group, y and z represent an integer from 1 to 3, $R_{12}$ and $R_{13}$ represent a hydrogen atom, methyl, ethyl, or propyl, $R_{14}$ and $R_{15}$ represent a hydrogen atom or an alkyl radical such that the sum of the carbon atoms in $R_{14}$ and $R_{15}$ does not exceed 10.

The polymers comprising such units can also comprise motifs derived from nonzwitterionic monomers such as dimethyl or diethylaminoethyl acrylate or methacrylate or alkyl acrylates or methacrylates, acrylamides or methacrylamides or vinyl acetate.

By way of example, mention may be made of the copolymer of methyl methacrylate/methyl dimethylcarboxymethylammonioethylmethacrylate such as the product sold under the name Diaformer Z301 by the supplier Sandoz.

(5) polymers derived from chitosan comprising monomer motifs corresponding to the following formulae:

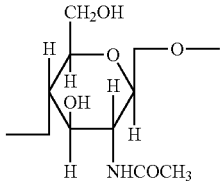

(D)

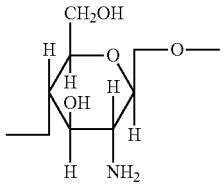

(E)

-continued (F)

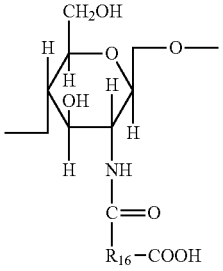

the motif D being present in proportions lying in the range 0 and 30%, the motif E in proportions lying in the range 5% and 50%, and the motif F in proportions lying in the range 30% and 90%, it being understood that, in this motif F, $R_{16}$ represents a radical of formula:

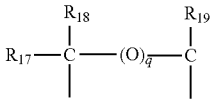

in which:

if q=0, $R_{17}$, $R_{18}$, and $R_{19}$, which may be identical or different, each represent a hydrogen atom, a methyl, hydroxyl, acetoxy, or amino residue, a monoalkylamine residue or a dialkylamine residue which are optionally interrupted by one or more nitrogen atoms and/or optionally substituted with one or more amine, hydroxyl, carboxyl, alkylthio, or sulfonic groups, an alkylthio residue in which the alkyl group carries an amino residue, at least one of the radicals $R_{17}$, $R_{18}$, and $R_{19}$ being, in this case, a hydrogen atom; or if q=1, $R_{17}$, $R_{18}$, and $R_{19}$ each represent a hydrogen atom, as well as the salts formed by these compounds with bases or acids.

(6) Polymers derived from the N-carboxyalkylation of chitosan, such as N-carboxymethylchitosan or N-carboxybutylchitosan sold under the name "Evalsan" by the supplier Jan Dekker.

(7) Polymers corresponding to the general formula (XXIV) which are described, for example, in French patent 1 400 366:

(XXIV)

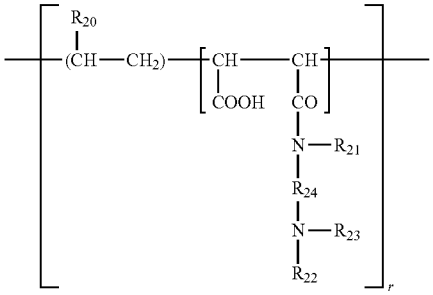

in which:

$R_{20}$ represents a hydrogen atom, a CH3O, CH3CH2O, or phenyl radical, $R_{21}$ denotes hydrogen or a lower alkyl radical such as methyl or ethyl, $R_{22}$ denotes hydrogen or a lower alkyl radical such as methyl or ethyl, $R_{23}$ denotes a lower alkyl radical such as methyl or ethyl or a radical corresponding to the formula: —$R_{24}$—N($R_{22}$)2, $R_{24}$ representing a —$CH_2$—$CH_2$—, —$CH_2$—$CH_2$—$CH_2$—, or —$CH_2$—CH ($CH_3$)— group, $R_{22}$ having the meanings mentioned above; as well as the higher homologues of these radicals and containing up to 6 carbon atoms.

(8) Amphoteric polymers of the type -D-X-D-X- chosen from:

a) polymers obtained by the action of chloroacetic acid or sodium chloroacetate on compounds comprising at least one motif of formula:

-D-X-D-X-D- (XXV)

where D denotes a radical

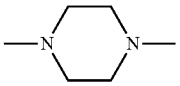

and X denotes the symbol E or E', E or E' which may be identical or different, denote a divalent radical which is an alkylene radical with a straight or branched chain containing up to 7 carbon atoms in the main chain, which is unsubstituted or substituted with hydroxyl groups and which can comprise, in addition to the oxygen, nitrogen, and sulfur atoms, 1 to 3 aromatic and/or heterocyclic rings; the oxygen, nitrogen, and sulfur atoms being present in the form of ether, thioether, sulfoxide, sulfone, sulfonium, alkylamine, or alkenylamine groups, hydroxyl, benzylamine, amine oxide, quaternary ammonium, amide, imide, alcohol, ester, and/or urethane groups.

b) polymers of formula:

-D-X-D-X- (XXV')

where D denotes a radical

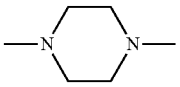

and X denotes the symbol E or E' and at least once E'; E having the meaning given above and E' is a divalent radical which is an alkylene radical with a straight or branched chain having up to 7 carbon atoms in the main chain, which is unsubstituted or substituted with one or more hydroxyl radicals and containing one or more nitrogen atoms, the nitrogen atom being substituted with an alkyl chain which is optionally interrupted by an oxygen atom and necessarily comprising one or more carboxyl functions or one or more hydroxyl functions and betainized by reaction with chloroacetic acid or sodium chloroacetate.

(9) ($C_1$-$C_5$) alkyl vinyl ether/maleic anhydride copolymers partially modified by semiamidation with an N,N-dialkylaminoalkylamine such as N,N-dimethylaminopropylamine or by semiesterification with an N,N-dialkanolamine. These copolymers can also comprise other vinyl comonomers such as vinylcaprolactam.

The amphoteric fixing polymers which are particularly preferred according to the invention are those of family (3), such as the copolymers whose CTFA name is octylacrylamide/acrylates/butylaminoethyl methacrylate copolymer, such as the products sold under the names Amphomer, Amhomer LV 71 or Lovocryl 47 by the supplier National Starch, and those of family (4) such as the copolymer of methyl methacrylate/methyl dimethylcarboxymethylammonioethylmethacrylate, for example, sold under the name Diaformer 2301 by the supplier Sandoz.

The nonionic fixing polymers that are suitable for use in the present invention are chosen, for example, from:

- vinylpyrrolidone homopolymers;
- copolymers of vinylpyrrolidone and of vinyl acetate;
- polyalkyloxazolines such as the polyethyloxazolines sold by the supplier Dow Chemical under the names Peox 50,000, Peox 200,000, and Peox 500,000;
- vinyl acetate homopolymers, such as the product sold under the name Appretan EM by the supplier Hoechst, or the product sold under the name Rhodopas A 012 by the supplier Rhône-Poulenc;
- copolymers of vinyl acetate and of acrylic ester, such as the product sold under the name Rhodopas AD 310 by Rhône-Poulenc;
- copolymers of vinyl acetate and of ethylene, such as the product sold under the name Appretan TV by the supplier Hoechst;
- copolymers of vinyl acetate and of maleic ester, for example of dibutyl maleate, such as the product sold under the name Appretan MB Extra by the supplier Hoechst;
- copolymers of polyethylene and of maleic anhydride;
- alkyl acrylate homopolymers and alkyl methacrylate homopolymers, such as the product sold under the name Micropearl RQ 750 by the supplier Matsumoto, or the product sold under the name Luhydran A 848 S by the supplier BASF;
- acrylic ester copolymers such as, for example, copolymers of alkyl acrylates and of alkyl methacrylates, such as the products sold by the supplier Rohm & Haas under the names Primal AC-261 K and Eudragit NE 30 D, by the supplier BASF under the names Acronal 601, Luhydran LR 8833 or 8845, and by the supplier Hoechst under the names Appretan N 9213 or N 9212;
- copolymers of acrylonitrile and of a nonionic monomer chosen, for example, from butadiene and alkyl(meth) acrylates; mention may be made of the products sold under the names Nipol LX 531 B by the supplier Nippon Zeon or those sold under the name CJ 0601 B by the supplier Rohm & Haas;
- polyurethanes, such as the products sold under the names Acrysol RM 1020 or Acrysol RM 2020 by the supplier Rohm & Haas, and the products Uraflex XP 401 UZ and Uraflex XP 402 UZ by the supplier DSM Resins;
- copolymers of alkyl acrylate and of urethane, such as the product 8538-33 by the supplier National Starch;
- polyamides, such as the product Estapor LO 11 sold by the supplier Rhône-Poulenc;
- unmodified or chemically modified nonionic guar gums.

The unmodified nonionic guar gums are, for example, the products sold under the name Vidogum GH 175 by the supplier Unipectine and under the name Jaguar C by the supplier Meyhall.

The modified nonionic guar gums that are suitable for use in the invention are preferably modified with $C_1$-$C_6$ hydroxyalkyl groups. Mention may be made, for example, of hydroxymethyl, hydroxyethyl, hydroxypropyl, and hydroxybutyl groups.

These guar gums are well known in the state of the art and can be prepared, for example, by reacting corresponding alkene oxides, such as, for example, propylene oxides, with guar gum so as to obtain a guar gum modified with hydroxypropyl groups.

Such nonionic guar gums optionally modified with hydroxyalkyl groups are sold, for example, under the trade names Jaguar HP8, Jaguar HP60, Jaguar HP120, Jaguar DC293, and Jaguar HP105 by the supplier Meyhall, or under the name Galactasol 4H4FD2 by the supplier Aqualon.

The alkyl radicals of the nonionic polymers have 1 to 6 carbon atoms except where otherwise mentioned.

The nonionic polymers that are most particularly suitable for preparing the compositions in accordance with the invention are those chosen from:

- vinyllactam copolymers such as copolymers of vinylpyrrolidone and of vinyl acetate and vinylpyrrolidone/vinyl acetate/vinyl propionate copolymers
- the polyvinylcaprolactam Luviskol Plus (BASF)
- vinyl acetate homopolymers such as Appretan EM (Hoechst) or Rhodopas A 012 (Rhône-Poulenc)
- polyalkyloxazolines such as Peox 50,000 and Peox 500,000 (Dow Chemical)
- copolymers of vinyl acetate and of acrylic ester such as Rhodopas AD 310 (Rhone-Poulenc)
- copolymers of vinyl acetate and of ethylene, such as Appretan TV (Hoechst)
- copolymers of vinyl acetate and of maleic ester, such as Appretan MB Extra (Hoechst)
- alkyl acrylate homopolymers and alkyl methacrylate homopolymers, such as Luhydran A 848 S (BASF)
- acrylic ester copolymers such as Primal AC-261 K (Rohm & Haas), Acronal 601 (BASF), or Appretan N 9.213 (Hoechst)
- copolymers of acrylonitrile and of a nonionic monomer such as CJ 0601 B (Rohm & Haas)
- polyurethanes such as Acrysol RM 1020 or Acrysol RM 2020 (Rohm & Haas)
- copolymers of alkyl acrylate and of urethane, such as 8538-33 (National Starch)
- polyamides such as Estapor LO 11 (Rhone-Poulenc).

According to the invention, it is also possible to use fixing polymers of grafted silicone type comprising a polysiloxane portion and a portion consisting of a nonsilicone organic chain, one of the two portions constituting the main chain of the polymer, the other being grafted onto said main chain. These polymers are described, for example, in patent applications EP-A-0 412 704, EP-A-0 412 707, EP-A-0 640 105, WO 95/00578, EP-A-0 582 152, and WO 93/23009, and U.S. Pat. Nos. 4,693,935, 4,728,571, and 4,972,037. These polymers are preferably anionic or nonionic.

Such polymers are, for example, copolymers that can be obtained by radical polymerization from the monomer mixture consisting of:

a) 50% to 90% by weight of tert-butyl acrylate;
b) 0 to 40% by weight of acrylic acid;
c) 5% to 40% by weight of silicone macromer of formula:

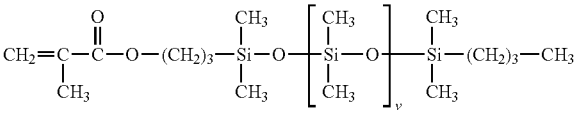

with v being a number lying in the range 5 to 700; the weight percentages being calculated relative to the total weight of the monomers.

Other examples of grafted silicone polymers are, in particular, polydimethylsiloxanes (PDMS) onto which are grafted, via a thiopropylene-type connecting chain, mixed polymer motifs of the poly(meth)acrylic acid type and of the polyalkyl (meth)acrylate type and polydimethylsiloxanes (PDMS) onto which are grafted, via a thiopropylene-type connecting chain, polymer motifs of the polyisobutyl (meth) acrylate type.

Functionalized or nonfunctionalized, silicone or nonsilicone polyurethanes may also be used as fixing polymers.

The cosmetic composition for hair that is used in the invention may also contain other compounds that are in the field of cosmetics for hair such as oxidants and in particular hydrogen peroxide, vitamins, and pro-vitamins, including panthenol, sun screens, colored or colorless inorganic or organic pigments, pearling and opacifying agents, sequestrating agents, plasticizers, solubilizing agents, anti-oxidants, hydroxyacids, fragrances, polymeric or non-polymeric inorganic or organic thickeners, and preservatives.

The composition may be applied to hair that is dry or wet. Application may be performed after shampooing, for example.

In an implementation, the method of the invention for treating the scalp and/or the hair may comprise applying a first composition to the scalp and/or the hair with or without an airbrush, and applying a second composition to the scalp and/or the hair by means of the airbrush, the second composition being chosen as a function of the first or vice-versa. The second composition may be applied before the first or vice versa, depending on the treatment being performed. The first composition, when applied prior to the second, may enhance the action of the second. The two compositions may also react with each other, where appropriate.

In an implementation, the method of the invention may include the use of one or more devices enabling the sprayed composition and/or the treated surface to be heated or cooled.

The method of the invention for treating the scalp and/or the hair may thus include a step or raising the temperature of the hair fibers using heater means. As heater means, it is possible to use a hair dryer, an iron, with or without the addition of steam, in particular as described in FR 2 921 805, an infrared device.

The method of the invention need not be therapeutic.

The expression "comprising a" should be understood as being synonymous with "comprising at least one" unless specified to the contrary.

The invention claimed is:

1. A spray system comprising:

an airbrush;

one or more removable containers that are closed initially, and that each contain a composition for spraying onto human keratinous materials, the composition being chosen from a group consisting of:

a composition for caring for or treating the scalp;

a composition for treating the hair;

a composition for applying before or after shampooing, dyeing, color stripping, perming, or defrizzing the hair; and a composition containing at least one compound chosen from the following compounds: anti-seborrheic compounds; anti-dandruff compounds; compounds promoting the growth of human keratinous fibers and/or limiting loss thereof and/or promoting an increase in their density; hair dyes; reducing agents; conditioning agents; anionic, nonionic, amphoteric, or zwitterionic surfactants; and fixing polymers; and a junction device that connects the container to the airbrush, the junction device including:

at least a composition-outlet first orifice enabling the composition to leave the container in order to be sprayed via the airbrush;

at least an air-inlet second orifice in the container enabling air intake by the container; and perforator means that are arranged so as to perforate the container, the perforator means including the composition-outlet first orifice.

2. The spray system according to claim 1, including a plurality of containers, the containers being interchangeable and containing compositions that are identical or different.

3. The spray system according to claim 1, the composition contained in the containers fastened on the airbrush being in contact with the outside air only via the junction device.

4. The spray system according to claim 1, the air-inlet orifice being at the level of the composition-outlet orifice, and being directly in contact with the outside air or communicating with the outside air via an air-intake channel that terminates by an air-entry orifice.

5. The spray system according to claim 4, the air-inlet orifice or the air-entry orifice being provided with a check valve.

6. The spray system according to claim 1, the junction device including an air-intake channel connecting the air-inlet second orifice and an air-entry orifice that communicates with the outside air and that is situated above the first and second orifices for composition outlet and for the air inlet.

7. The spray system according to claim 1, wherein the perforator means are inserted into the orifices.

8. The spray system according to claim 7, the perforator means being needles.

9. The spray system according to claim 1, the junction device including:

at least one housing for receiving the container; and an annular gasket that is arranged so as to snap-fasten and to bear in leaktight manner on the container when said container is in place in the housing.

10. The spray system according to claim 1, wherein when the composition being chosen is the composition for caring for or treating the scalp, the composition for caring for or treating the scalp comprises at least one agent chosen from a group of agents consisting of: anti-dandruff agents, anti-hairloss or hair-regrowth agents, anti-seborrhoea agents, anti-inflammatory agents, anti-irritants or soothing agents, concealers, or agents for stimulating or protecting the scalp.

11. The spray system according to claim 1, wherein when the composition chosen is the composition for treating the hair, the composition for treating the hair is chosen from a group of compositions consisting of: a composition for washing the hair; a composition for caring for or conditioning the hair; a composition for temporarily shaping or holding the hair; a composition for temporarily, semi-permanently, or permanently dyeing; and a composition for defrizzing or perming the hair.

12. The spray system according to claim 1, the perforator means including the air-inlet second orifice enabling air intake.

13. The spray system according to claim 12, the perforator means being needles.

14. The spray system according to claim 12, wherein the perforator means are arranged to perforate closure means of the container.

15. The spray system according to claim 13, the perforator means comprising two needles, the two needles presenting side openings that define the composition-outlet first orifice and the air-inlet second orifice, respectively.

16. The use of the spray system according to claim 1 for treating the hair and/or the scalp.

17. A spray system comprising:

an airbrush;

one or more removable containers that are closed initially, and that each contain a composition for spraying onto human keratinous materials, the composition being chosen from a group consisting of:

a composition for caring for or treating the scalp;

a composition for treating the hair;

a composition for applying before or after shampooing, dyeing, color stripping, perming, or defrizzing the hair; and a composition containing at least one compound chosen from the following compounds: anti-seborrheic compounds; anti-dandruff compounds; compounds promoting the growth of human keratinous fibers and/or loss thereof and/or promoting an increase in their density; hair dyes; reducing agents; conditioning agents; anionic, nonionic, amphoteric, or zwitterionic surfactants; and fixing polymers;

a junction device that connects the container to the airbrush, the junction device including:

at least a composition-outlet first orifice enabling the composition to leave the container in order to be sprayed via the airbrush;

at least an air-inlet second orifice enabling air intake by the container; and an air-intake channel connected to the air-inlet orifice, the air-intake channel terminating by an air-entry orifice situated beneath a base of the junction device, the air-intake channel including a valve.

* * * * *